US008333370B2

(12) United States Patent
Walsh

(10) Patent No.: US 8,333,370 B2
(45) Date of Patent: Dec. 18, 2012

(54) SEPARATOR BELT FINGER COUNT APPARATUS AND METHOD

(75) Inventor: James Andrew Walsh, Ashland, WI (US)

(73) Assignee: C.G. Bretting Manufacturing Co., Inc., Ashland, WI (US)

( * ) Notice: Subject to any disclaimer, the term of this patent is extended or adjusted under 35 U.S.C. 154(b) by 392 days.

(21) Appl. No.: 12/759,784

(22) Filed: Apr. 14, 2010

(65) Prior Publication Data

US 2011/0255946 A1 Oct. 20, 2011

(51) Int. Cl.
*B41L 1/32* (2006.01)

(52) U.S. Cl. ..... 270/39.02; 270/32; 270/39.01; 270/39.05

(58) Field of Classification Search ..... 270/32, 270/39.01, 39.02, 39.05, 39.06; 493/413, 493/430, 433, 451, 454; 414/788.8
See application file for complete search history.

(56) References Cited

U.S. PATENT DOCUMENTS

| | | | | |
|---|---|---|---|---|
| 4,277,058 | A * | 7/1981 | Biggar, III | 493/433 |
| 4,285,621 | A * | 8/1981 | Spencer | 414/790 |
| 4,736,936 | A | 4/1988 | Hertel et al. | |
| 4,770,402 | A | 9/1988 | Couturier | |
| 4,874,158 | A | 10/1989 | Retzloff | |
| 4,938,465 | A | 7/1990 | Marsiletti | |
| 5,040,663 | A | 8/1991 | Gould et al. | |
| 5,110,101 | A * | 5/1992 | Roth | 270/39.02 |
| 5,730,695 | A | 3/1998 | Hauschild et al. | |
| 6,290,635 | B1 * | 9/2001 | Demmel et al. | 493/399 |
| 6,322,315 | B1 | 11/2001 | Schmidt, V et al. | |
| 6,641,358 | B2 | 11/2003 | Schmidt, V et al. | |
| 7,264,583 | B2 * | 9/2007 | Gelli et al. | 493/430 |
| 7,470,102 | B2 * | 12/2008 | Gendron et al. | 414/796 |
| 7,997,570 | B2 * | 8/2011 | De Matteis | 270/39.02 |
| 8,240,653 | B2 * | 8/2012 | Walsh et al. | 270/39.02 |
| 2006/0073007 | A1 * | 4/2006 | De Matteis | 414/789.9 |
| 2011/0158782 | A1 * | 6/2011 | Walsh et al. | 414/790.1 |
| 2012/0190524 | A1 * | 7/2012 | Butterworth et al. | 493/451 |

FOREIGN PATENT DOCUMENTS

| | | | |
|---|---|---|---|
| DE | 1611343 | B1 | 4/1972 |
| EP | 2 377 792 | A2 | 10/2011 |

* cited by examiner

*Primary Examiner* — Leslie A Nicholson, III
(74) *Attorney, Agent, or Firm* — Reinhart Boerner Van Deuren P.C.

(57) ABSTRACT

The invention provides a method and apparatus for separating a stack of folded sheets by inserting a first, second, third and fourth count fingers into four successive openings in the stack, and separating the stack between the second and third count fingers. Where separation is carried out after a desired number of folded sheets have passed the third count finger, a completed pack having the desired number of sheets may be formed downstream from the third count finger. The count fingers may be operatively mounted in count finger cassettes.

33 Claims, 12 Drawing Sheets

SEPARATOR BELT FINGER COUNT APPARATUS AND METHOD

FIELD OF THE INVENTION

This invention relates to a method and apparatus for separating a stack of folded articles, such as paper towels, napkins, facial tissues or the like, into packs having a desired number of folded articles.

BACKGROUND OF THE INVENTION

There are many products, as exemplified by paper tissue, toweling and napkins, etc., which are commonly provided to consumers in stacked form as packs of folded or interfolded individual sheets. These packs of stacked sheets are often staple items which must be produced at very low cost. Producing such products at low cost typically requires the use of high-speed processes and equipment. Such processes are not limited to the production and delivery of paper products, but are widely used in the production of other products such as foil, textile, synthetic sheeting and other industries.

Such products are often formed from one or more continuous webs of materials or from one or more streams of sheets which are folded in a folding apparatus into the desired configuration and deposited in a stacking region extending downstream from the folding apparatus. The stack of sheets in the stacking region is then periodically separated into packs having a desired number of sheets.

Experience has shown that the steps of cutting individual sheets from a web or webs of material, and folding or interfolding the individual sheets to form a stack of folded sheets can be accomplished at higher speeds than subsequent downstream processes such as: separating a stack of the folded material into individual packs having a desired number of sheets; performing secondary folding of a lead or trailing sheet of each pack; and delivering the completed pack to downstream packaging equipment used to wrap or otherwise prepare the completed packs for delivery and sale.

In the past, a variety of approaches have been utilized for: separating stacks of folded sheets into packs; performing any necessary secondary folding operations; and transporting the completed packs to downstream processing equipment. Some of these prior approaches are illustrated in the following US patents which are commonly assigned to the assignee of the present invention: U.S. Pat. No. 4,770,402 to Couturier; U.S. Pat. No. 4,874,158 to Retzloff; U.S. Pat. No. 6,641,358 to Schmidt et al.; and U.S. Pat. No. 6,322,315 to Schmidt et al.

Although the apparatuses and methods taught by Couturier and in other prior approaches as exemplified by the US patents listed above have been successful and commercially viable in the past, further improvement is desirable. Specifically, it is desirable to provide a separation method and apparatus which is operable at higher speeds than can be achieved using prior approaches. Also, it is desirable to provide improved separation methods and apparatuses having a more straightforward construction and operation, ideally having fewer components, which can be produced and operated at lower cost and with higher efficiency and reliability.

Prior separating methods and apparatuses have also generally been limited to use with folded sheets issuing along a substantially vertically oriented folded sheet path to form a stack in which the successive sheets rest vertically upon one another. It is desirable to provide an improved apparatus and method for separating stacks of sheets oriented in a direction other than vertical, and particularly desirable to provide a method and apparatus for separating a horizontally-directed stack of sheets into individual packs.

BRIEF SUMMARY OF THE INVENTION

The invention provides a method and apparatus for separating a stack of folded sheets by inserting a first, second, third and fourth count fingers into four successive openings in the stack, and separating the stack between the second and third count fingers. Where separation is carried out after a desired number of folded sheets have passed the third count finger, a completed pack having the desired number of sheets may be formed downstream from the third count finger.

A separation method or apparatus, according to the invention, may be utilized for separating stacks of sheets oriented vertically, horizontally, or at some other angle for horizontal and vertical. Separation, according to the invention, may also be utilized in combination with a wide variety of folding apparatuses and methods, and be performed at separation rates which are substantially higher than can be achieved with previous separating methods and apparatuses. The invention also may be practiced utilizing apparatuses which are elegantly simple in their construction and operation, to thereby provide significant advancements and advantages over prior separating apparatuses and methods. In some forms of the invention, one or more count fingers and their associated drive and guide members may be advantageously combined into a count finger cassette of compact size and rugged construction which will readily be recognized as providing a number of significant advances and advantages over prior approaches to separating stacks of folded articles into packs.

In one form of the invention, a method is provided for separating a stack of folded sheets disposed in a stacking region into completed packs having a desired number of folded sheets. The stacking region extends in a downstream direction along a folded sheet path, with the folded sheets in the stack having successive folds alternatively disposed on opposite sides of the folded sheet path, with each fold joining two successive panels of the sheet opening from one another on the opposite side of the folded sheet path to form an opening between successive folds. The method includes inserting first, second, third and fourth count fingers into the stack respectively into four successive openings in the stack, and separating the stack between the second and third count fingers to form a completed pack downstream from the third count finger.

The invention may also include moving the completed pack out of the stacking region. The invention may further include pulling the completed pack away from the remainder of the stack by moving the inserted first and second count fingers together in a downstream direction.

Some forms of the invention may include inserting the first and second count fingers into the stack at opposite transverse edges of a penultimate panel of a last folded sheet of the completed pack, downstream and upstream respectively from the penultimate panel. The third and fourth count fingers are inserted into the stack at opposite transverse edges of a second panel of a first sheet of the next pack, upstream and downstream respectively from the second panel.

Some forms of the invention may include inserting a strip finger between the second and third count fingers over the penultimate panel of the completed pack. The strip finger may then be utilized for moving the completed pack in a downstream direction as part of the process of moving the completed pack out of the stacking region. A build finger may also be positioned downstream from a first panel of the completed pack for supporting the downstream end of the completed pack. In similar fashion, in some forms of the invention, a build finger is positioned downstream from the first panel of the next pack for supporting the downstream end of the next pack.

In some forms of the invention, the completed pack is pulled away from the remainder of the stack by moving the first and second count fingers together in the downstream direction. In some forms of the invention, a separator finger may be inserted between the second and third strip fingers to facilitate pulling the completed pack away from the remainder of the stack.

In some forms of the invention, the first and second count fingers are moved away from the third and fourth count fingers in the downstream direction after all four count fingers are inserted into the four successive openings, to thereby create a gap between the second and third count fingers. A strip finger and/or build finger may then be inserted into the gap to facilitate pulling the completed pack away from the remainder of the pack and/or supporting the downstream end of the next pack. In some forms of the invention, a strip finger inserted into the stack upstream from the second count finger is moved in a downstream direction together with the first and second count fingers. In other forms of the invention, once the strip finger has been inserted upstream from the second count finger, the first and second count fingers are refracted. In some forms of the invention, after a build finger is inserted between the second and third count fingers, downstream from the first panel of the next pack, the third and fourth count fingers are retracted and the build finger is used for supporting the downstream end of the next pack.

Separation, according to the invention, may be carried out while the stack is being built in the stacking region. For example, where the stack of folded sheets is moving at a build rate in the downstream direction along the folded sheet path as folded sheets are added to an upstream end of the stack in the folding region, the four count fingers may be inserted into the moving stack in such a manner that the four count fingers continue to move in a downstream direction along the folded sheet path as the stack continues to build upstream from the count fingers in the folding region. In some forms of the invention, the first and second count fingers may then be moved away from the third and fourth count fingers in the downstream direction, after all four count fingers are inserted into the four successive openings, at a speed greater than the build rate, to thereby create a gap in the stack between the second and third count fingers.

Where the invention is practiced with a stack moving at the build rate in the downstream direction through the stacking region, the invention may also include inserting strip and/or build fingers between the second and third count fingers while the count fingers are moving in the downstream direction, and also moving the strip and/or build fingers in the downstream direction. In forms of the invention having a stack moving at the build rate through the stacking region, wherein the first and second build fingers are moved away from the third and fourth count fingers to create a gap between the second and third count fingers, strip and/or build fingers moving at the build rate or another rate of speed may be inserted into the gap formed between the second and third count fingers.

In some forms of the invention, a single set of four count fingers is utilized for performing each and every separation of the stack into packs.

In other forms of the invention, another set of four count fingers may be utilized for making the next separation in the stack, in the same manner as the separation was performed using the first set of count fingers to perform the first separation.

In some forms of the invention, each of the first, second, third and fourth count fingers is driven independently. It will be appreciated, by those having skill in the art, that even with each count finger being driven independently by a separate drive source, the present invention requires fewer drive or actuation arrangements than have been required in prior separation apparatuses and methods.

In some forms of the invention, each of the first, second, third and fourth count fingers is individually mounted for independent movement along the folded sheet path. In some forms of the invention, each of the count fingers is fixedly attached to a separate endless drive member for independent movement along a separate closed count finger path having a working segment thereof disposed in a path extending substantially parallel to the folded sheet path along at least a portion of the stacking region. In some forms of the invention, multiple ones of at least one of the first, second, third and fourth count fingers may be fixedly attached to the same endless drive members at a desired angular displacement therebetween. For example, in some forms of the invention two "first" count fingers may be attached to the same endless drive member at an angular displacement of 180 degrees from one another, to add increased flexibility and speed in practicing of the invention.

In one form of the invention, a method is provided for separating a stack of folded sheets into individual packs having a desired number of sheets, while the stack is being continually built in a stacking region extending from an upstream to a downstream direction along a folded sheet path with the stack moving generally downstream at a build rate. The folded sheets in the stack have successive folds in the stack alternatively disposed on opposite sides of the folded sheet path, with each fold joining two successive panels opening from one another on the opposite side of the folded sheet path to form an opening between successive folds. The downstream end of the pack being built is supported with a build finger. When the pack being built has reached the desired number of folded sheets, first, second, third and fourth count fingers are sequentially inserted into four successive openings in the stack as the stack continues to build upstream from the third and fourth count fingers. The first and second count fingers are inserted into the stack at opposite transverse edges at a penultimate panel of a last folded sheet of the completed pack, downstream and upstream respectively from the penultimate panel. The third and fourth count fingers are inserted into the stack at opposite transverse edges of a second panel of a first sheet of the next pack, upstream and downstream respectively from the second panel, to define a completed pack downstream from the third count finger.

The count fingers are moved downstream at the build rate until all of the count fingers have been inserted. The first and second count fingers are then moved in the downstream direction, away from the third and fourth count fingers, at a speed faster than the build rate to form a gap between the second and third count fingers, and to pull the completed pack away from the remainder of the stack. In some forms of the invention, a strip finger may then be inserted into the gap between the second and third count fingers over the penultimate panel of the completed pack. The completed pack may then be moved out of the folding region using the strip finger at an upstream end of the completed pack and the build finger at the downstream end of the completed pack. The first and second count fingers may also be utilized for pulling the completed pack out of the stacking region. Alternatively, in some forms of the invention, the first and second count fingers may be retracted after insertion of the strip finger.

In some forms of the invention, the completed pack may then be removed from and/or released by the build and strip fingers, and the downstream end of the next pack may be transferred from the third and fourth count fingers to the build finger.

A method, according to the invention, may utilize any combination of the processes and steps described above. A method, according to the invention, may be repeated for separation of each complete pack from the remainder of the stack.

The invention may also take the form of an apparatus for performing any method according to the invention.

An apparatus, according to the invention, may include first, second, third and fourth count fingers configured and operatively connected for sequential insertion, starting with the first count finger and ending with the fourth count finger, into the stack, to separate the stack between the second and third count fingers into a downstream portion of the stack extending downstream from the third count finger and an upstream portion of the stack extending upstream from the third count finger. The apparatus may form a completed pack downstream from the third count finger having a desired number of folded sheets, and a next pack upstream from the third count finger. The next pack may be supported upstream from the third and fourth count fingers as additional folded sheets are added to build the next pack into a completed pack having a desired number of sheets.

The count fingers may be configured and operatively connected such that, the first and second count fingers are insertable into the stack at opposite transverse edges of a penultimate panel of a last folded sheet of a completed pack, with the first and second count fingers being insertable downstream and upstream respectively from the penultimate panel. The third and fourth count fingers may be insertable into the stack at opposite transverse edges of a second panel of a first sheet of the next pack, with the third and fourth count fingers being insertable upstream and downstream respectively from the second panel. The count fingers may be further configured and operatively connected in such a manner that the first and second count fingers are movable away from the third and fourth count fingers in the downstream direction, for pulling the completed pack away from the remainder of the stack.

The count fingers may each be individually mounted for independent movement along the folded sheet path. Each of the count fingers may be fixedly attached to a separate endless drive member for independent movement along a separate closed count finger path having a working segment thereof disposed in a portion of the count finger path extending substantially parallel to the folded sheet path along at least a portion of the stacking region. The first and third count fingers may be attached to first and third count finger endless drive members disposed on a first transverse side of the stacking region, with the working segment of the closed count finger path for the first count finger endless drive member being disposed in a substantially parallel side-by-side operating relationship to the working segment of the closed count finger path for the third count finger endless drive member. The second and fourth count fingers may be attached to second and fourth count finger endless drive members disposed on a second opposite transverse side of the stacking region, with the working segment of the closed count finger path for the second count finger endless drive member being disposed in a substantially parallel side-by-side operating relationship to the working segment of the closed count finger path for the fourth count finger endless drive member.

An endless drive member, according to the invention, may take any appropriate form including, but not being limited to a: belt, chain, cable, strap, or any functionally equivalent structure. In one form of the invention, the endless drive members take the form of synchronous belts.

In some forms of the invention, at least one of the respective first, second, third and fourth count fingers and the endless drive member to which that respective count finger is attached may be part of a count finger cassette drive arrangement having a rotatable drive element and at least one rotatable idler element mounted for rotation with respect to a cassette frame member, for moving the endless drive member and the count finger around the closed count finger path. A guide member may also be attached to the cassette frame for guiding the endless drive member along a linear path for a portion of the closed count finger path.

In forms of the invention having a count finger cassette arrangement, the count finger cassette may be operatively mounted adjacent a transverse side of the stacking region in such a manner that the linear path defined by the guide member extends parallel to the folded sheet path. The linear path may be substantially coplanar with the working segment of the count finger path, and in some forms of the invention the linear path may define the working segment of the portion of the count finger path.

In some forms of the invention, a count finger cassette may include two of the count fingers and their associated drive arrangements. In such forms of the invention, the count finger cassette may include a cassette frame, a first and a second endless drive member each having at least one count finger attached thereto. The first endless drive member and the second endless drive member are each operatively mounted to the cassette frame for independent movement along separate first and second endless drive member paths, with the first and second endless drive member paths being disposed substantially parallel to one another in a side-by-side relationship. The first endless drive member has at least one count finger attached thereto. In similar fashion, the second endless drive member also has at least one count finger attached thereto.

A count finger cassette, according to the invention, may also include first and second rotatable drive elements, operatively and respectively connect the first and second endless drive members to the cassette frame. The first and second rotatable drive elements are also adapted for attachment thereto of respective first and second drivers for rotating the rotatable drive elements about respective first and second drive axes extending substantially perpendicular to the paths of the endless drive members. The cassette may further include first and second rotatable idler elements operatively and respectively connecting the first and second endless drive members to the cassette frame for rotation about respective first and second idler element axes extending substantially perpendicular to the paths of the endless drive members.

In some forms of a count finger cassette, according to the invention, the axis of the first drive element is coaxial with the axis of the second idler element, and the axis of the second drive element is coaxial with the axis of the first idler element. The first endless drive member is operatively connected to the first drive and idler elements, and is moveable by the first drive element independently from the second endless drive member. The second endless drive member is operatively connected to the second drive and idler elements, and is moveable by the second drive element independently from the first endless drive member.

The first and second drive elements may be journaled to the cassette frame for rotation with respect to the cassette frame about the first and second drive element axes, respectively.

The first and second idler elements may be journaled upon the second and first drive elements respectively, for rotation with respect to the cassette frame and also with respect to the second and first drive elements about the second and first drive element axes, respectively.

In some forms of the invention, the count fingers are operatively mounted in a first and second count finger cassette arrangement, with the first count finger cassette arrangement including the first and third count fingers, and the second count finger arrangement including the second and fourth count fingers. The first and second count finger cassette arrangements are mounted along opposite transverse sides of the folded sheet path in the stacking region, for practicing the invention.

In some forms of the invention, a plurality of count finger arrangements, each having two of the count fingers operatively attached to be driven by a separate one of the first and second drive elements are mounted with their drive element axes being aligned to form an array of count finger cassettes having their respective count fingers align substantially parallel to the drive element axes. With such an arrangement, for example, a plurality of first count finger cassette arrangements may each include a first and a third count finger, according to the invention, with the first and third count fingers being respectively aligned with one another in a timed relationship with respect to and about the drive element axes. In some forms of the invention, at least one common drive shaft may extend along one of the drive element axes to drive the drive elements disposed about the one drive element axis of a plurality of cassettes in unison with one another. In some forms of the invention, a second common drive shaft may extend along the other drive member axes for driving the plurality of other drive elements about the other of the drive element axes of the cassettes in unison. In some forms of the invention, the cassettes are supported on one or both of the drive shafts.

The invention may also take the form of a count finger cassette, for separating a stack of folded sheets into packs having a desired number of sheets. A count finger cassette, according to the invention, may include a single one of the first, second, third and fourth count fingers. Alternatively, a count finger cassette, according to the invention, may include a pair of the first, second, third and fourth count fingers.

One form of a count finger cassette, according to the arrangement includes a frame, first and second rotatable drive elements, first and second rotatable primary idler elements, first and second endless drive members each having at least one count finger extending outward therefrom, and a guide element. The frame defines first and second spaced parallel rotational axes. The first and second drive elements are respectively journaled for rotation independently from one another about the first and second rotational drive axes. The first drive element is adapted to receive a first driving input for driving the first drive element about the first drive axis. In similar fashion, the second drive element is adapted to receive a second driving input for driving the second drive element about the second drive axis.

The first primary idler element is journaled for rotation upon and independently from the second rotatable drive element about the second rotational axis. The second primary idler element is journaled for rotation upon and independently from the first rotatable drive element about the first rotational axis.

The first endless drive member is drivingly engaged with a portion of the outer peripheries of the first primary idler element and the first rotatable drive element, to thereby at least partly define a first substantially planar path for traveling the first endless drive member extending generally perpendicular to, and around the first and second rotational axes.

The second endless drive member is drivingly engaged with a portion of the outer peripheries of the second primary idler element and the second rotatable drive element, to thereby at least partly define a second substantially parallel path for travel of the second endless element extending generally perpendicular to, and around the first and second rotational axes, with the second planar path lying in a substantially side-by-side relationship to the first substantially planar path.

The guide members attached to the frame and configured for urging both the first and second endless drive members to travel substantially in parallel with one another along a substantially straight line for a portion of the respective paths of travel of the first and second endless members.

In some forms of the invention, the first and second rotatable drive elements of a cassette, according to the invention, may include respective central bores therein for passage therethrough of respective first and second drive shafts. The drive shafts are drivingly securable to the first and second drive shafts respectively. In some forms of the invention, for example, the drive shafts are keyed to their respective drive element, for example.

In some forms of a cassette, according to the invention, the cassette may include one or more additional idler elements mounted to the frame for rotation about respective additional idler element axes. The additional idler elements are operatively connected to one or the other of the first and second endless drive members for further defining the path of one or the other of the first and second endless drive members. Some forms of a cassette, according to the invention, may also include at least one separator element disposed between adjacent rotatable parts mounted for rotation about the same rotational axis.

The invention may also take the form of a folding and separating apparatus including a folding roll and a count finger cassette according to the invention. The folding roll may be rotatably mounted for rotation about a roll axis, for providing a stream of folded sheets to a stacking region located downstream from the roll. The roll may include an annular groove therein, opening outward through the periphery of the roll. The count finger cassette may have a portion thereof that is operatively disposed within the annular groove. The annular groove in the roll may define a width thereof in the axial direction of the roll axis. The portion of the count finger cassette disposed in the annular groove may have a width, in the direction of the roll axis, that is less than the width of the annular groove. The count finger cassette in such an embodiment of the invention may take the form of any count finger cassette described herein or in keeping with the scope of the invention. The count finger cassette, in such a folding and separating apparatus, may also have a width in the direction of the roll axis that is sufficiently less than the width of the annular groove to allow for entry of other elements, such as a packing finger as is known in the art for example, into the annular groove alongside the count finger cassette.

Other aspects, objects and advantages of the invention will be apparent from the following detailed description and accompanying drawings describing exemplary embodiments of the invention.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
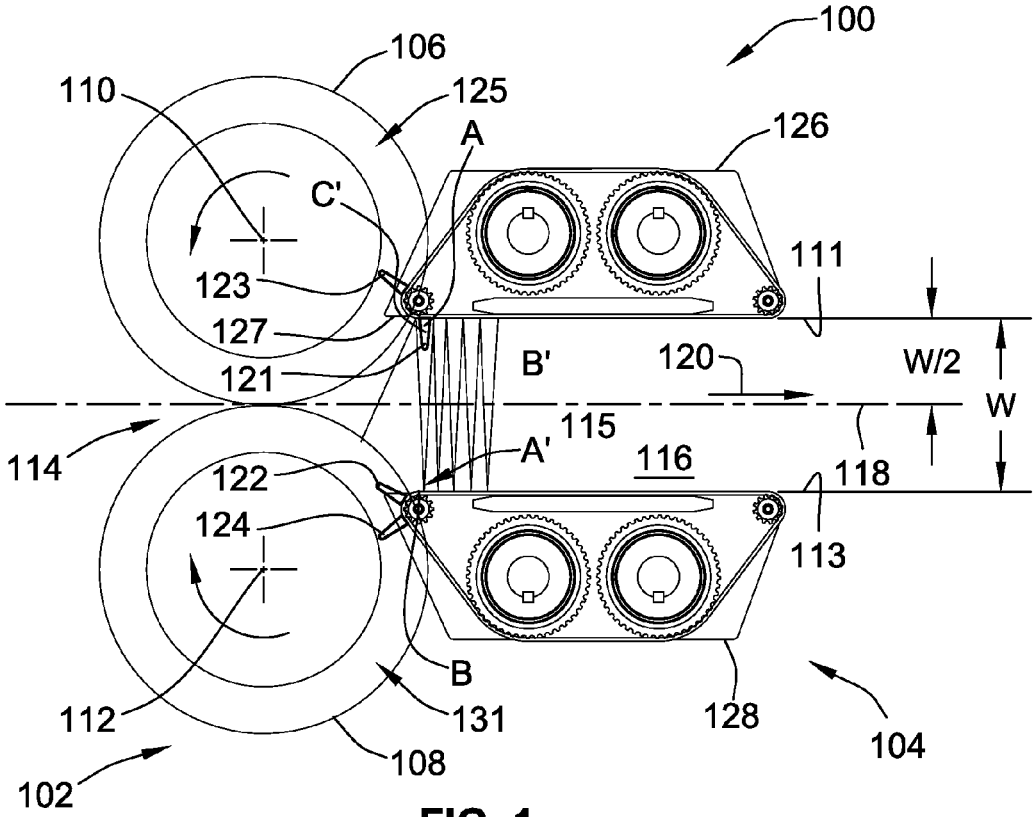
FIGS. 1-6 are sequential schematic illustrations of an apparatus and method for separating a stack of folded sheets at a desired point in the stack, by inserting first, second, third and fourth count fingers into the stack, respectively, into four successive openings in the stack and separating the stack between the second and third fingers, according to the invention.

While the invention will be described in connection with certain preferred embodiments, there is no intent to limit it to those embodiments. On the contrary, the intent is to cover all alternatives, modifications and equivalents as included within the spirit and scope of the invention.

DETAILED DESCRIPTION OF THE INVENTION

FIGS. 1-6 are schematic illustrations showing the construction and operation of an exemplary embodiment of a folding and separating apparatus 100 according to the invention. The folding and separating apparatus includes a folding arrangement 102 and a separating arrangement 104.

The folding arrangement 102 of the exemplary embodiment 100 is a typical counter-rotating folding roll arrangement of a type well known in the art. Specifically, the folding arrangement 102 includes a first and a second folding rolls 106, 108, mounted for counter-rotation about first and second folding roll axes 110, 112. The first and second roll axes 110, 112 extend parallel to one another, and the first and second rolls 106, 108 are positioned to form a nip 114 between outer peripheries 105, 107 of the rolls 106, 108.

Figure 18:
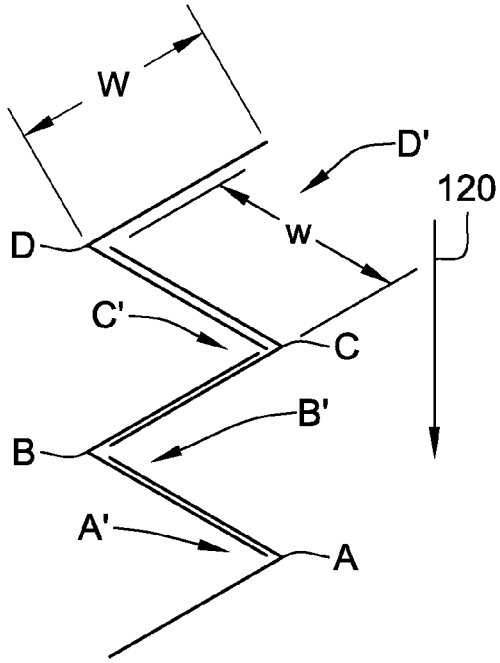
FIG. 18 is a schematic illustration of a first exemplary embodiment of a folded sheet configuration that may be separated, in accordance with the invention, wherein each sheet has two full-width panels joined along a fold, to form an "on-fold" pattern, also commonly referred to as a "single-fold" pattern.
Figure 19:
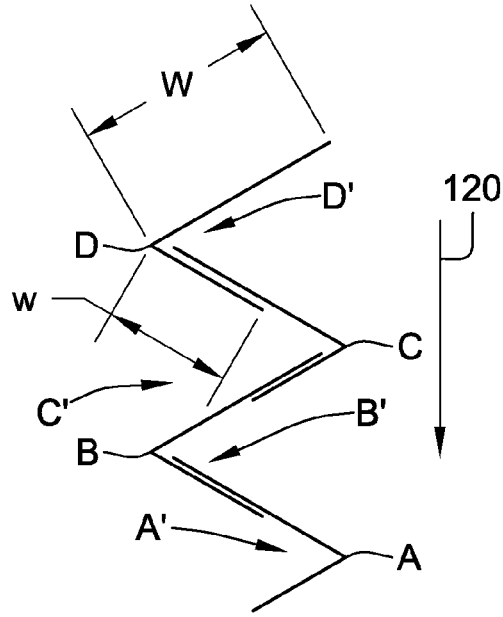
FIG. 19 shows a second exemplary embodiment of a stack of interfolded sheets, which may be separated according to the invention, wherein each sheet has one full-width panel joined to a shortened width panel along one of the folds, to form a folding configuration known as an "off-fold" pattern.
Figure 20:
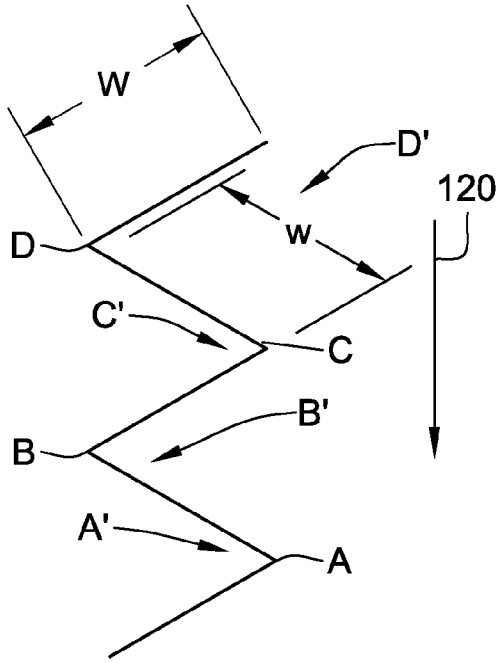
FIG. 20 is a schematic illustration of an exemplary embodiment of a folding pattern, which may be utilized in accordance with the invention, wherein adjacent panels of successive sheets are not interfolded, but are rather connected at every one of the folds to form a zig-zag pattern which may include perforations or other lines of weakness spaced to allow separation of the sheets, or alternately may be formed continuously and cut periodically to separate the stack into individual packs.

A stream of cut sheets, or a web of material is fed through the nip 114 and folded or interfolded by the rolls 106, 108, into a desired folded configuration, such as one of the patterns illustrated in FIGS. 18-20, for example. The folding rolls 106, 108 feed a stream of folded sheets to the separating arrangement, which is located downstream from the folding arrangement 102.

More specifically, the sheets folded by the folding arrangement 102 are disposed in a stacking region 116 of the separating arrangement 104. The stacking region 116 extends along a folded sheet path 118 defining a downstream direction, as indicated by arrow 120. The folded sheet path 118 may be thought of as a plane extending generally parallel to the roll axes 110, 112 through the nip 114 between the folding rolls 106, 108. In FIGS. 1-7, the folded sheet path 118 is indicated as a dashed line 118 extending generally perpendicularly to a common plane (not shown) passing through the roll axes 110, 112 in a vertical direction with the folding rolls 106, 108 oriented with the first folding roll 106 located directly above the second folding roll 108 as illustrated herein in FIGS. 1-7. Stated another way, the sheet path 118 as shown in FIGS. 1-7 is an edge view of the plane defining the sheet path 118. Although the sheet path 118 can be curved or otherwise deviate from a straight flat plane downstream from the folding rolls in other embodiments of the invention, the sheet path can be considered to extend generally perpendicularly to the vertical centerlines of the roll axes 110, 112 in an area just downstream from the folding rolls 106, 108 for the purpose of describing the invention. In the exemplary embodiment 100, the sheet path 118 continues to extend generally perpendicularly to the vertical centerlines of the roll axes 110, 112 through the stacking region 116.

The folded sheets in the stack 115 have successive folds A, B, C . . . n, in the stack 115 alternatively disposed on opposite sides of the folded sheet path 118. Each fold A, B, C . . . n joins two successive panels opening from one another on the opposite side of the folded sheet path to form an opening A', B', C' . . . n' between successive folds.

As will be understood from FIG. 1, the stack 115 of folded sheets has width transverse to the sheet path 118 that is substantially equal to the width W of a full panel of the folded sheets. The stacking region 116 extends a transverse distance W/2 equal to one half of the full panel width W on each side of the sheet path 118.

The exemplary embodiment of the folding and separating apparatus 100 can be utilized with a variety of folded sheet configurations, three of which are illustrated in FIGS. 18-20.

For example, FIG. 18 shows a stack of interfolded sheets, with each sheet having two full-width (W) panels joined along a fold (A, B, C, D). Because the leading and trailing edges of the sheets are disposed at one of the folds A, B, C, D, this folding configuration is known as an "on-fold" pattern, and is also commonly referred to as a "single-fold" pattern.

FIG. 19 shows an interfolded configuration in which each sheet has one full width panel (W) joined to a shortened width panel (w) along one of the folds A, B, C, D. Because the leading edges of the shortened width panels (w) are not disposed at one of the folds A, B, C, D, this folding configuration is known as an "off-fold" pattern.

FIG. 20 shows a configuration in which the adjacent panels of successive sheets are not interfolded, but rather are connected at every other one of the folds A, B, C, D, to form a zig-zag pattern. Such a configuration may include perforations or other lines of weakness spaced to allow separation of the sheets. Alternatively, the zig-zag pattern may be formed continuously and cut periodically to separate the stack into individual packs.

It will be understood that the configurations shown in FIGS. 18-20 are provided for illustrative purposes only. The invention may also be practiced with efficacy with a variety of other sheet folding and stacking configurations.

The separating arrangement 104 in the first exemplary embodiment of the folding and separating apparatus 100 includes first, second, third and fourth count fingers 121, 122, 123, 124 configured and operatively connected for sequential insertion, in a manner described in more detail below, to separate the stack 115 into separate parts upstream and downstream from the third count finger 123.

In the first exemplary embodiment of the folding and separating apparatus 100, the first and third count fingers 121, 123 are part of a first (or upper in the orientation illustrated in FIG. 1) count finger cassette 126, and the second and fourth count fingers 122, 124 are part of a second count finger cassette 128 (located below the folded sheet path 118 in FIG. 1). The construction and operation of the first and second count finger cassettes 126, 128 will be discussed in more detail below.

FIGS. 1-6 are sequential illustrations of the manner in which the four count fingers 121, 122, 123, 124 of the separator arrangement 104 may be utilized for separating the stack 115 into an upstream and a downstream portion 130, 134 of the stack of sheets. In general, as will be understood from the description provided below, the first, second, third and fourth count fingers 121, 122, 123, 124 are configured and operatively connected for sequential insertion, starting with the first count finger 121 and ending with the fourth count finger 124, into the stack 115 to separate the stack 115 between the second and third count fingers 122, 123 into separate parts 130, 134. Where a downstream portion 134 of the separated stack 115 includes a desired number of folded sheets, the downstream portion of the stack 115 will constitute a completed pack 148 having the desired number of sheets.

In FIG. 1, the first count finger 121 has been positioned in a first opening B' of the stack 115.

Figure 2:
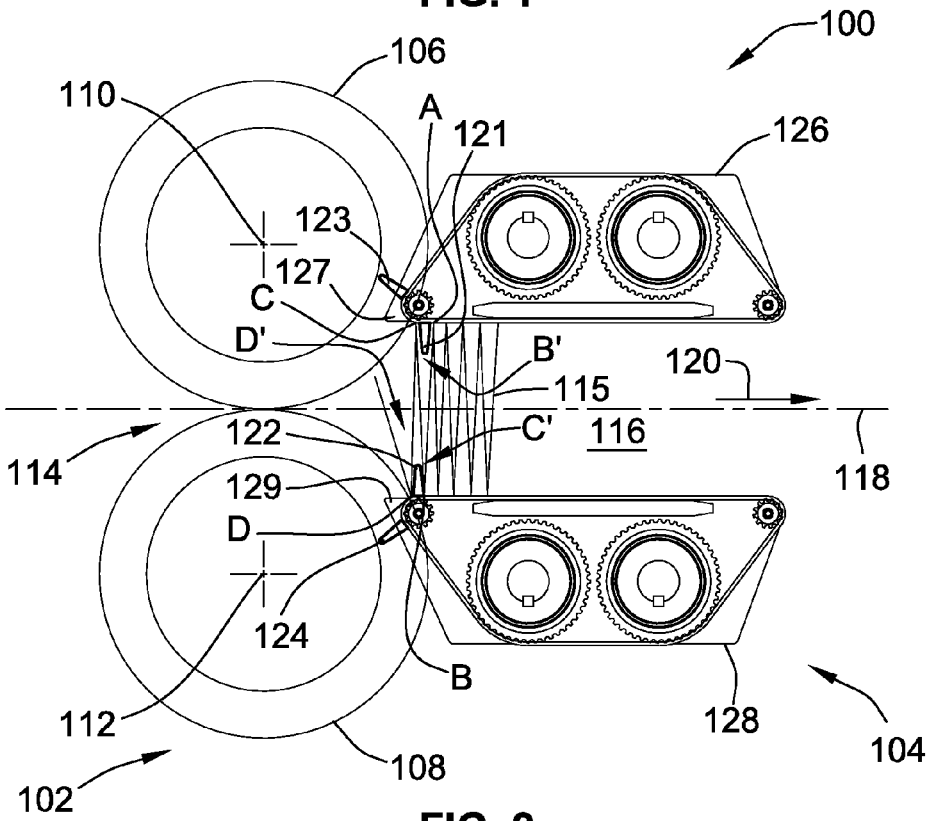

As shown in FIG. 2, after insertion of the first count finger 121 into the first opening B', the first count finger 121 continues to move in unison with the stack 115 along the folded sheet path 118 in the downstream direction 120 at a build rate determined by how rapidly the folding rolls 106, 108 are depositing additional folds C, D . . . n into the stacking region 116 upstream from the first count finger 121.

As further indicated in FIG. 2, the second count finger 122 is inserted into the next space C' on the opposite side of the stack 115 from the opening B' into which the first count finger 121 was inserted. After insertion of both the first and second count fingers 121, 122 into their respective openings B', C' the separating arrangement 104 continues to move the first and second count fingers 121, 122 in the downstream direction 120 at the build rate as the first and second folding rolls 106, 108 continue to feed additional folded sheets into the stacking region 116 of the separating arrangement 104.

Figure 3:
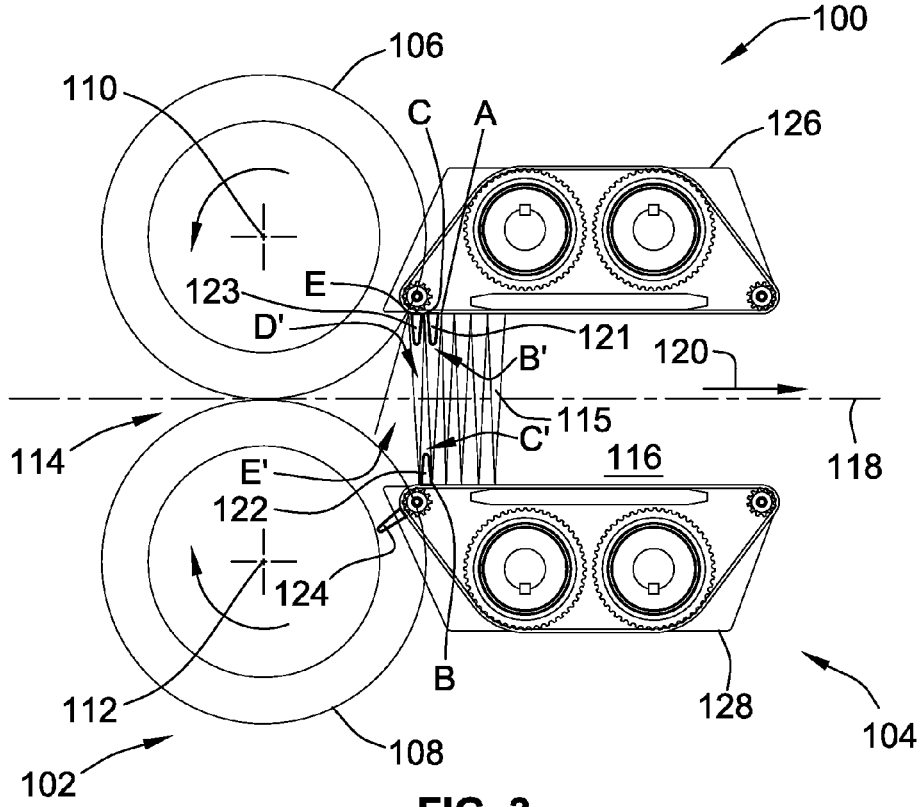

As shown in FIG. 3, the separator arrangement 104 then inserts the third count finger 123 into the next opening D' in the stack 115, such that the first, second and third count fingers 121, 122, 123 are sequentially inserted into sequential openings B', C' and D' between successive folds A, B, C, D, E of the stack 115. After insertion of the third count finger 123, the separator apparatus 104 continues to move the first, second and third count fingers 121, 122, 123 in the downstream direction 120 at the build rate, in unison with the stack 115.

Figure 4:
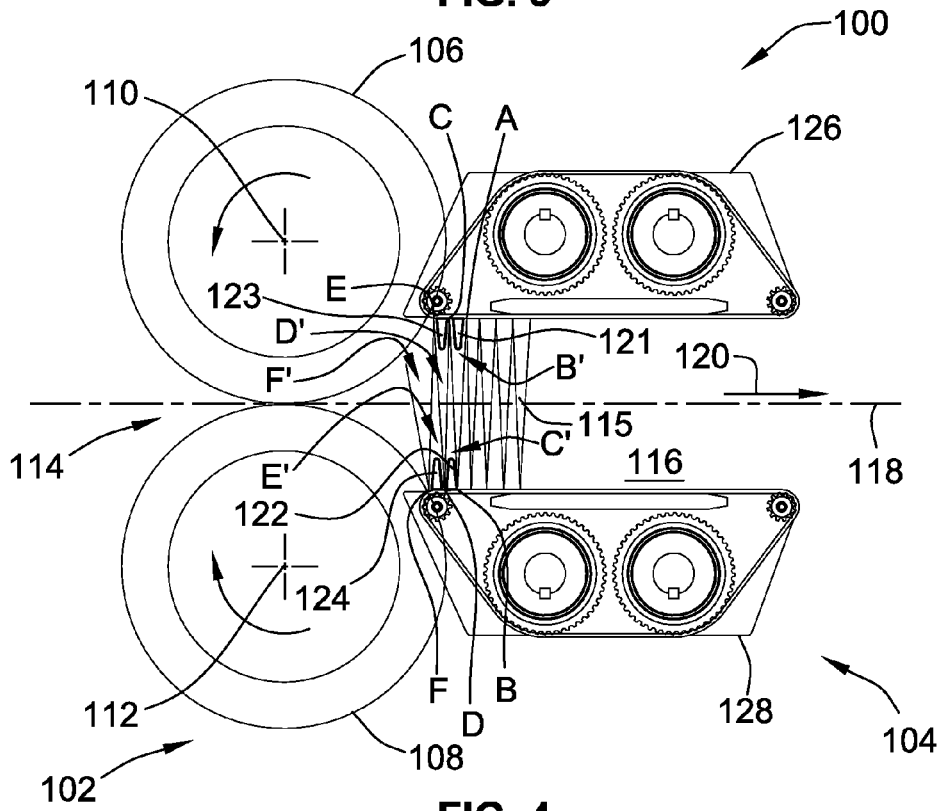

As shown in FIG. 4, the fourth count finger 124 is inserted by the separator arrangement 104 into the next successive opening E' in the stack 115, to complete the sequential insertion of the count fingers 121, 122, 123, 124, into successive openings B', C', D', E' between successive folds A, B, C, D, E, F of the stack 115.

Figure 5:
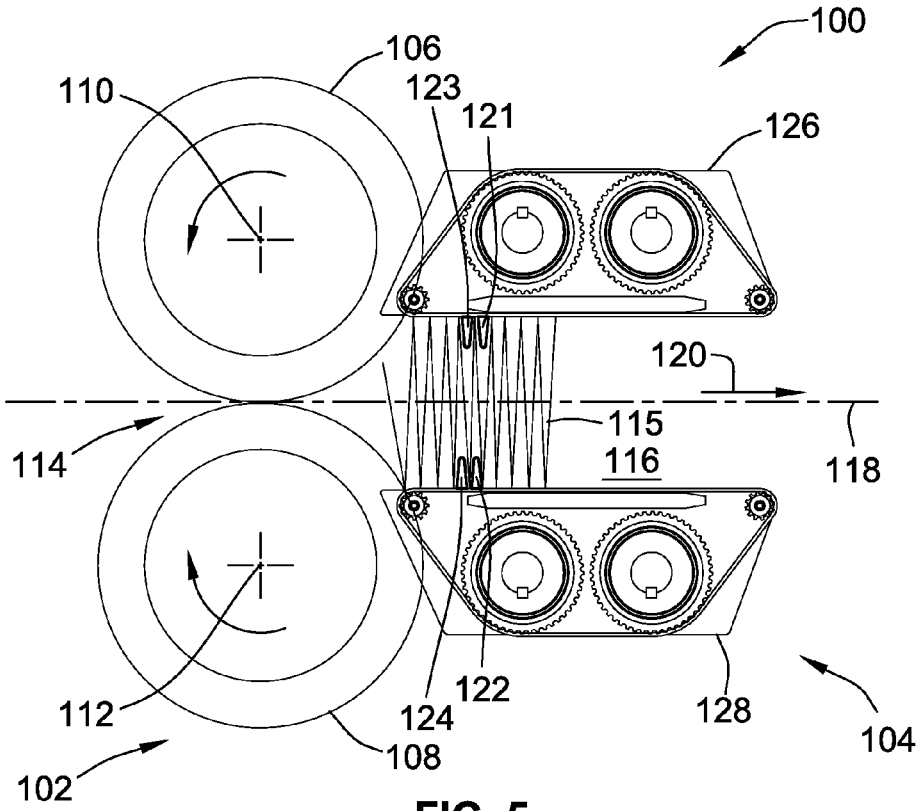

As shown in FIG. 5, once all four count fingers 121, 122, 123, 124, are sequentially inserted into the stack 115, the separator arrangement 104 continues to drive the count fingers 121, 122, 123, 124 in the downstream direction 120 at the build rate, so that the first and second folding rolls 106, 108 can continue to deposit folded sheets upstream of the third and fourth count fingers 123, 124 to thereby complete building of an upstream portion of the stack 115.

Figure 6:
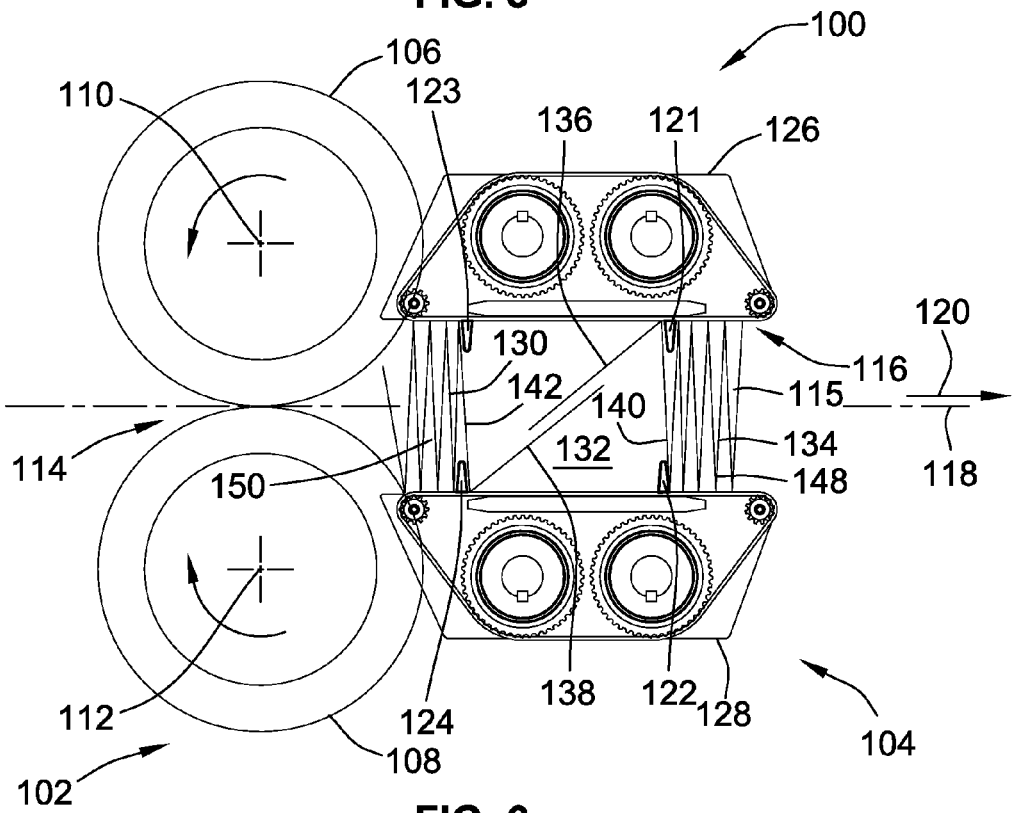

As shown in FIG. 6, at a desired point in the continued building of the upstream portion 130 of the stack 115, the separator arrangement 104 drives the first and second count fingers 121, 122 at a different rate than the third and fourth count fingers 123, 124 are being driven, to thereby open a gap 132 between the upstream portion 130 and the downstream portion 134 of the stack 115. For example, the separator arrangement 104 may continue to drive the third and fourth count fingers 123, 124 at the build rate while driving the first and second count fingers 121, 122 at a speed faster than the build rate to thereby form the gap 132. In other embodiments of the invention, the desired gap 132 may be opened by slowing or momentarily stopping the third and fourth count fingers 123, 124 while continuing to advance the first and second count fingers 121, 122 in the downstream direction 120. It is also contemplated that the gap 132 can be opened, in some embodiments of the invention, by momentarily reversing the direction of travel of the third and fourth count fingers 123, 124 so that they travel upstream instead of downstream 120.

As further shown in FIG. 6, the downstream portion 134 of the stack 115 terminates in a last panel 136, and the upstream portion 130 of the stack 115 terminates in a first panel 138. As specifically illustrated in FIG. 6, the last panel 136 of the downstream portion 134 of the stack 115 is a full-width panel which has been interfolded by the folding rolls 106, 108 with the first panel 138 of the upstream portion 130 of the stack 115. Such interfolding of adjacent panels is often utilized in packs of paper napkins or tissues which are to be drawn one-at-a-time from an opening in a dispenser, in such a manner that, as each sheet is withdrawn from the dispenser, the interfolded trailing panel of the dispensed sheet pulls a leading panel of the next sheet out of an opening in the dispenser to, in turn, facilitate pulling the next sheet out of the dispenser.

Although operation of the first exemplary embodiment of the folding and separating apparatus 100 has been described herein with regard to a stack 115 of material having an interfolded first and last panel 138, 136, it will be understood that the invention is not limited to use with interfolded products. It will be understood, by those having skill in the art, from the descriptions given herein, that the invention can also be practiced with efficacy for separating stacks of non-interfolded material, including but not limited to: stacks of material having perforations or lines of weakness in the panels where separation of the stack is desired; or stacked, folded or non-folded individual sheets which are not interfolded.

From an examination of FIG. 6, it will be understood that, by virtue of the sequential manner in which the count fingers 121, 122, 123, 124 are inserted into the stack 115, the first and second count fingers 121, 122 are of necessity inserted into the stack at opposite transverse edges of a penultimate panel 140 of a last folded sheet of the downstream portion 134 of the stack 115, with the first count finger 121 being inserted downstream from the penultimate panel 140 and the second count finger 122 being inserted upstream from the penultimate panel 140. It will be further understood that, by virtue of the insertion sequence described above, the third and fourth count fingers 123, 124 are of necessity inserted into the stack downstream and upstream respectively of a second panel 142 of the upstream portion 130 of the stack 115. Where the downstream portion 134 of the stack 115 constitutes a desired number of sheets for a completed pack, it will be understood that the penultimate panel 140 is the penultimate panel 140 of a completed pack 148, and the second panel 142 may constitute the second panel 142 of the next pack 150 to be separated from the stack 115 by the separator arrangement 104.

In some forms of the invention, the separator arrangement 104 can simply continue to drive the first and second count fingers 121, 122 in the downstream direction 120 at a faster rate than the third and fourth count fingers 123, 124 are being driven to complete the separation of the upstream and downstream portions 130, 134 of the stack 115 from one another. In other forms of the invention, the separator arrangement 104 will also include other elements, such as a strip finger and/or a build finger which are utilized in conjunction with the four count fingers 121, 122, 123, 124. Operation of one form of the invention utilizing strip and build fingers 144, 146 is described below in conjunction with FIGS. 8-14.

Figure 7:
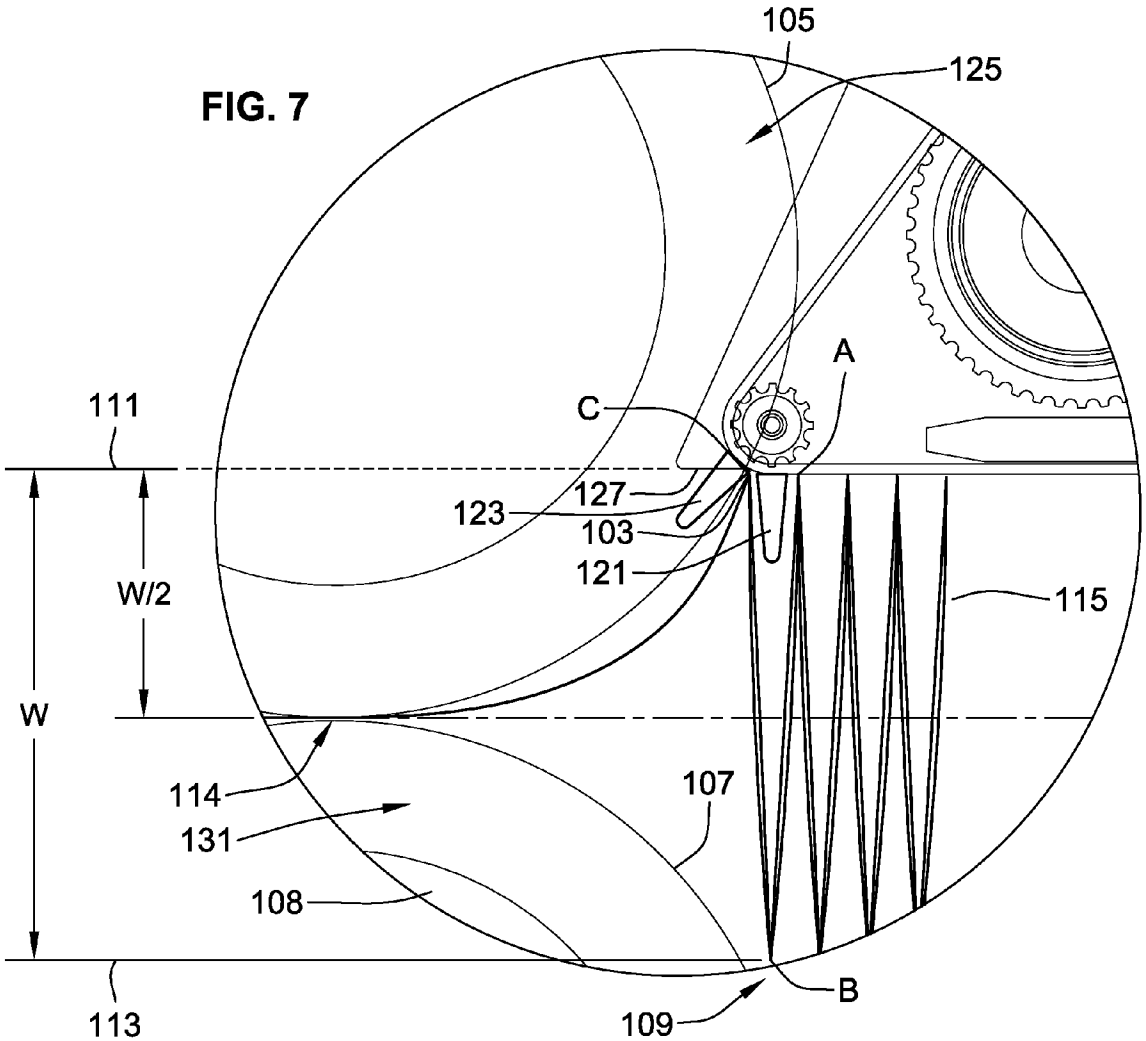
FIG. 7 is an enlarged view of a portion of the apparatus shown in FIGS. 1-6, illustrating a desired location and timing for insertion of the count fingers into a folding roll operating in conjunction with a separator apparatus, according to the invention, and further illustrating a desirable configuration and location for a folded sheet guide to facilitate removal of the folded sheets from a folding roll in accordance with exemplary embodiments of an apparatus and method of the invention.

As shown in FIG. 7, it is desirable in some embodiments of the invention for the count fingers 121, 122, 123, 124 to be respectively inserted into a space in the stack 115 at a point of intersection of the roll peripheries 105, 107 with of a pair of first and second (upper and lower as shown in FIG. 7) datum planes 111, 113 extending parallel to the sheet path 118, and disposed on opposite sides of the sheet path 118 at a distance W/2 substantially equal to one-half of the full panel width W. In practicing the invention, these points of intersection substantially correspond with locations along the peripheries 105, 107 of the rolls 106, 108 where the folds A, B, C . . . n leave the periphery 105, 107 of one of the folding rolls 106, 108.

It is also contemplated that grippers (not shown) holding the folded sheets to the rolls 106, 108 during the folding process will release their grip on the folded sheets substantially as the folds A, B, C . . . n reach the intersection points 103, 109 of the roll peripheries 105, 107 with the count fingers 121, 122, 123, 124 at the half-full panel distance W/2 on either side of the sheet path 118, or at an angular position along the peripheries 105, 107 just before the folds A, B, C . . . n reach the intersection points 103, 109 of the roll peripheries 105, 107.

As specifically illustrated in FIG. 7 with regard to insertion of the first count finger 121 into the opening B' formed by fold B between folds A and C in the manner described above in relation to FIG. 1, the first count finger 121 is preferably inserted into the opening B' at a point of intersection 103 of the periphery 105 of the first roll 106 and the first (upper) datum plane 111. This is substantially the point at which it is desirable for every other fold A, C, E . . . n in the stack of folded sheets to separate from the periphery 105 of the roll 106 and move downstream into the stacking region 116 in order to properly form the stack 115. With specific regard to the first count finger 121, the timing of insertion into the opening B' should occur at the point of intersection 103 of the periphery 105 of the first roll 106 and the first (upper) datum plane 111 substantially at the same time, or slightly prior to the time that the fold C reaches the point of intersection 103 of the periphery 105 of the first roll 106 and the first (upper) datum plane 111.

Although not expressly illustrated in the drawings, it will be understood that the insertion of the third count finger 123 into the opening D', in the manner described above in relation to FIG. 3, should also occur at the point of intersection 103 of the periphery 105 of the first roll 106 and the first (upper) datum plane 111 substantially at the same time, or slightly prior to the time that the fold E reaches the point of intersection 103 of the periphery 105 of the first roll 106 and the first (upper) datum plane 111.

In similar fashion, it will be understood that the insertion of the second count finger 122 into the opening C', in the manner described above in relation to FIG. 2, should occur at the point of intersection 109 of the periphery 107 of the second roll 108 and the second (lower) datum plane 113 substantially at the same time, or slightly prior to the time that the fold D reaches the point of intersection 109 of the periphery 107 of the second roll 108 and the second (lower) datum plane 113. It will be further understood that insertion of the fourth count finger 124 into the opening E', in the manner described above in relation to FIG. 4, should occur at the point of intersection 109 of the periphery 107 of the second roll 108 and the second (lower) datum plane 113 substantially at the same time, or slightly prior to the time that the fold F reaches the point of intersection 109 of the periphery 107 of the second roll 108 and the second (lower) datum plane 113.

As also shown in FIGS. 1, 2 and 7, the exemplary embodiment of the folding and separating apparatus 100 also provides a first folded sheet guide 127 extending substantially along the first datum plane 111 through the point of intersection 103 of the periphery 105 of the first roll 106 and the first (upper) datum plane 111, to help direct the folded sheets away from the periphery 105 of the first roll 106. In the exemplary embodiment 100, the first folded sheet guide 127 is provided by a corner of a frame of the first count cassette 126 which extends into a groove 125 in the first folding roll 106, in a manner described in more detail below. In other embodiments of the invention, a first folded sheet guide 127 may be formed in a different manner than by the corner of a first count finger cassette 126.

In similar fashion, as shown in FIGS. 2 and 7, the exemplary embodiment of the folding and separating apparatus 100 provides a second folded sheet guide 129 extending substantially along the second datum plane 113 through the point of intersection 109 of the periphery 107 of the second roll 108 and the second (lower) datum plane 113, to help direct the folded sheets away from the periphery 107 of the second roll 108. In the exemplary embodiment 100, the second folded sheet guide 129 is provided by a corner of a frame of the second count cassette 128 which extends into a groove 131 in the second folding roll 108, in a manner described in more detail below. In other embodiments of the invention, a second folded sheet guide 129 may be formed in a different manner than by the corner of a second count finger cassette 128.

As will be understood by those having skill in the art, during the process of folding successive sheets, the sheets are held against the peripheries 105, 107 of the folding rolls 106, 108 by gripper arrangements (not shown), at various points along the peripheries 105, 107 of the folding rolls 106, 108. Such gripper arrangements may be mechanical, vacuum operated, or any other appropriate form known in the art. During operation of the invention, it is contemplated that the gripper arrangements release the sheets just before the folds reach the first and second points of intersection 103, 109 respectively.

As is known in the art, folded sheets sometimes have a tendency to follow the peripheries of the folding rolls for a short angular distance after the folds have been released by the gripper arrangements. The folded sheet guides 127, 129 of the invention help to guide the folded sheets into the stacking region 116. As will be appreciated from the drawings and descriptions of exemplary embodiments herein, the ability to place the folded sheet guides 127, 129 closely adjacent the first and second points of intersection 103, 109 afforded by the cassettes 126, 128, or other structures in accordance with the invention, provides considerable advantage as compared to prior structures and methods for urging separation of folded sheets from folding rolls, particularly in folding rolls operating at higher speeds.

The exemplary embodiment of a folding and separating apparatus shown in FIGS. 8-14 is essentially identical to the folding and separating apparatus 100 described above, with reference to FIGS. 1-6, with the exception that the apparatus 100 shown in FIGS. 8-14 includes a strip finger 144 and a build finger 146. Accordingly, the same reference numerals used in the description relating to the embodiment shown in FIGS. 1-6 will be used, wherever possible, in the following description of the embodiment shown in FIGS. 8-14.

Figure 8:
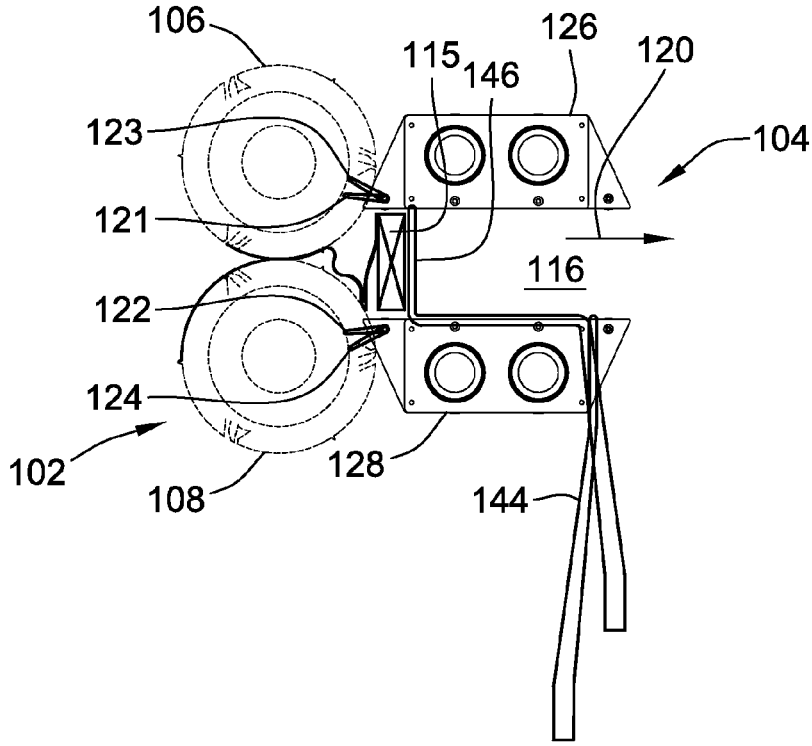
FIGS. 8-14 are sequential schematic illustrations of the embodiment of the invention of FIGS. 1-6 further including a strip and a build finger, and illustrating use of the invention for separating the stack into packs having a desired number of folded sheets.

As illustrated in FIG. 8, the build finger 146 is supporting the downstream end of the stack 115, as additional folded sheets are added to the stack 115 by the folding rolls 106, 108. The separator arrangement 104 is configured to move the build finger 146 in the downstream direction 120 at the build rate, to accommodate the sheets being added at the upstream end of the stack 115 by the folding rolls 106, 108. As further shown in FIG. 8, the count fingers 121, 122, 123, 124 are all shown in a refracted ready position at an upstream end of the separator arrangement 104, in preparation for their being inserted into the stack 115 in the manner described above with regard to FIGS. 1-6. As further shown in FIG. 8, the strip finger 144 is in a retracted position wherein the strip finger 144 does not extend into the stacking region 116.

Figure 9:
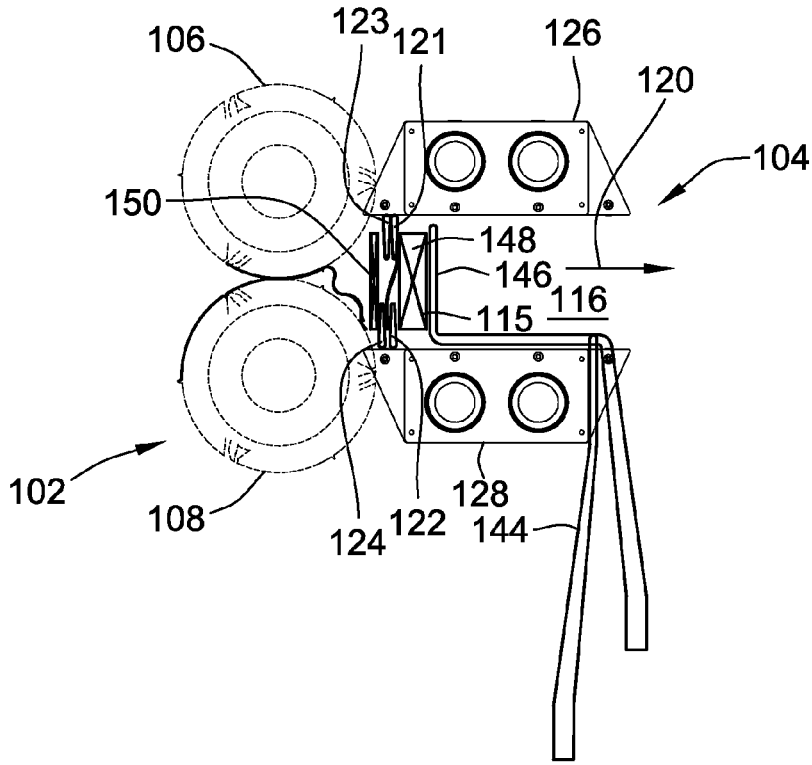

As shown in FIG. 9, the count fingers 121, 122, 123, 124 have been inserted sequentially into the stack 115, in the manner described in more detail hereinabove with regard to FIGS. 1-6, to separate the stack 115 into a downstream portion containing a desired number of folded sheets, to thereby form a completed pack 148. The folding rolls 106, 108 continue to deposit folded sheets on an upstream side of the third and fourth count fingers 123, 124 to thus continue building the next pack 150. As the next pack 150 continues to build, the separator arrangement 104 continues to move the count fingers 121, 122, 123, 124, and the build finger 146 in the downstream direction 120 through the stacking region 116 at the build rate, to accommodate additional folded sheets being added to the upstream side of the next pack 150 by the folding rolls 106, 108. As further shown in FIG. 9, the strip finger 144 remains in its retracted and ready position.

Figure 10:
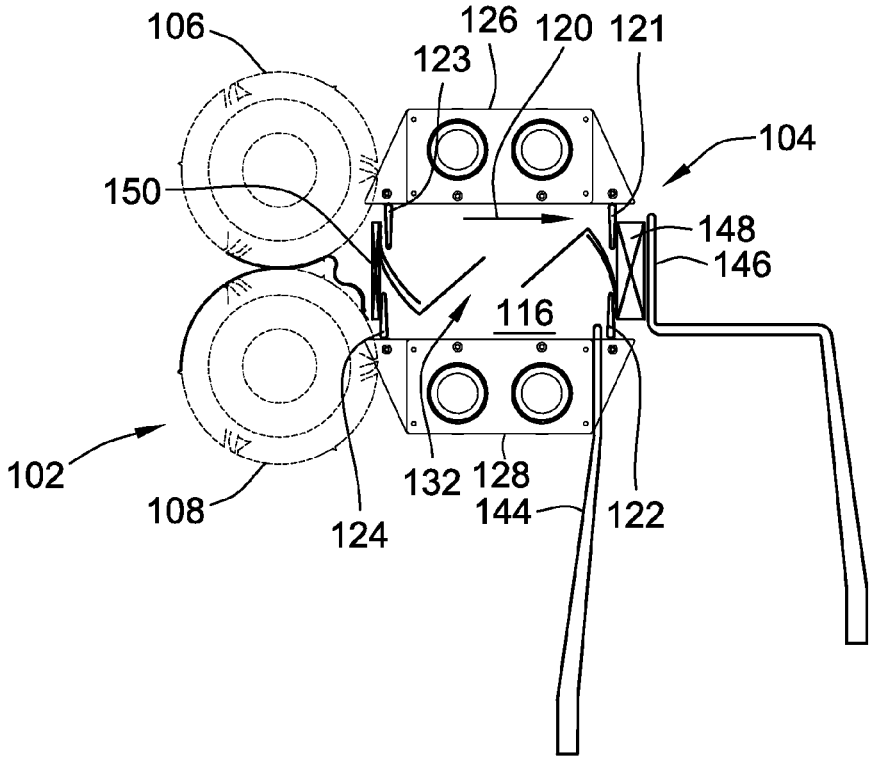

FIG. 10 illustrates a point in operation of the separator arrangement 104, where the third and fourth count fingers 123, 124 continue to move in the downstream direction 120 at the build rate, as the folding rolls 106, 108 continue to add new folded sheets to the upstream side of the next pack 150. The first and second count fingers 121, 122 have been driven in a downstream direction, by the separator arrangement 104, at a rate faster than the third and fourth count fingers 123, 124, to thereby open a gap 132 between the second and third count fingers 122, 123. The build finger 146 has been moved in the downstream direction 120 substantially in unison with the first and second count fingers 121, 122, to thereby move the completed pack 148 to the downstream end of the stacking region 116.

Figure 11:
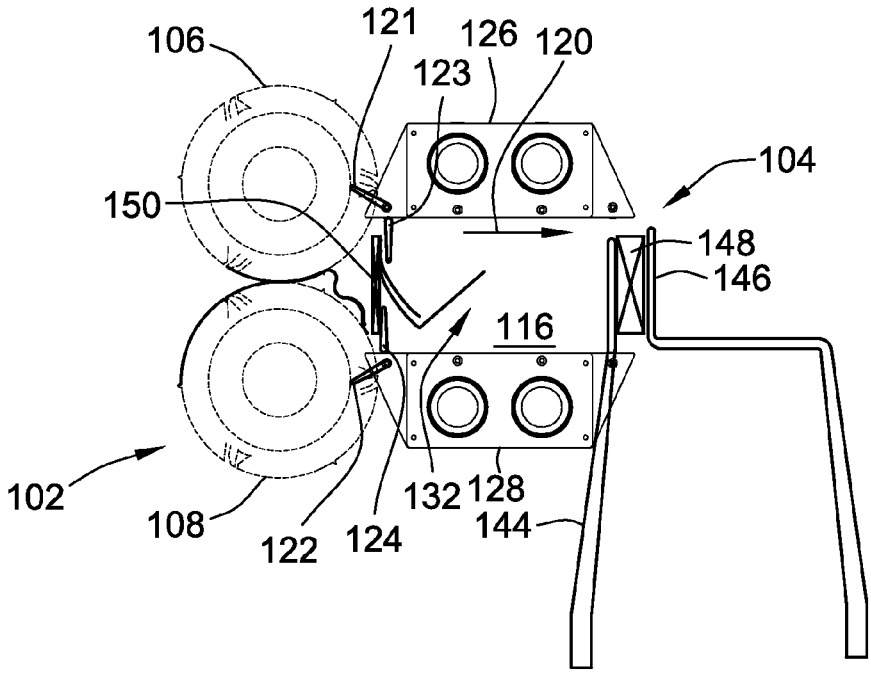

At the point in operation of the separator arrangement 104 shown in FIG. 11, the strip finger 144 has been inserted into the gap 132 in the stacking region 116 to bear against an upstream surface of the completed pack 148, and the first and second count fingers 121, 122 have been retracted by being driven around the downstream ends of the first and second count finger cassettes 126, 128 in the manner described in more detail below, and returned to a ready position at the upstream end of the separator arrangement 104. The third and fourth count fingers 123, 124 continue to be moved in the downstream direction 120 by the separator arrangement 104 to accommodate the additional folded sheets being added to the upstream end of the next pack 150. In the exemplary embodiment, the first and third count fingers 121, 123, mounted in the first count finger cassette 128 are driven in a counter-clockwise direction around a periphery of the first count finger cassette 126 for insertion into the folds of the stack 115 at an upstream end of the first cassette 126, and for retraction from the folds in the stack 115 at downstream end of the first cassette 126, with the first and second cassettes 126, 128 being viewed as shown in FIGS. 1-13. The second and fourth count fingers 122, 124 are moved around the periphery of the second count finger cassette 128 in an opposite direction (clockwise as shown in FIGS. 1-13) to the direction of motion of the first and third count fingers 121, 123, for insertion and retraction of the second and fourth count fingers 122, 124.

Figure 12:
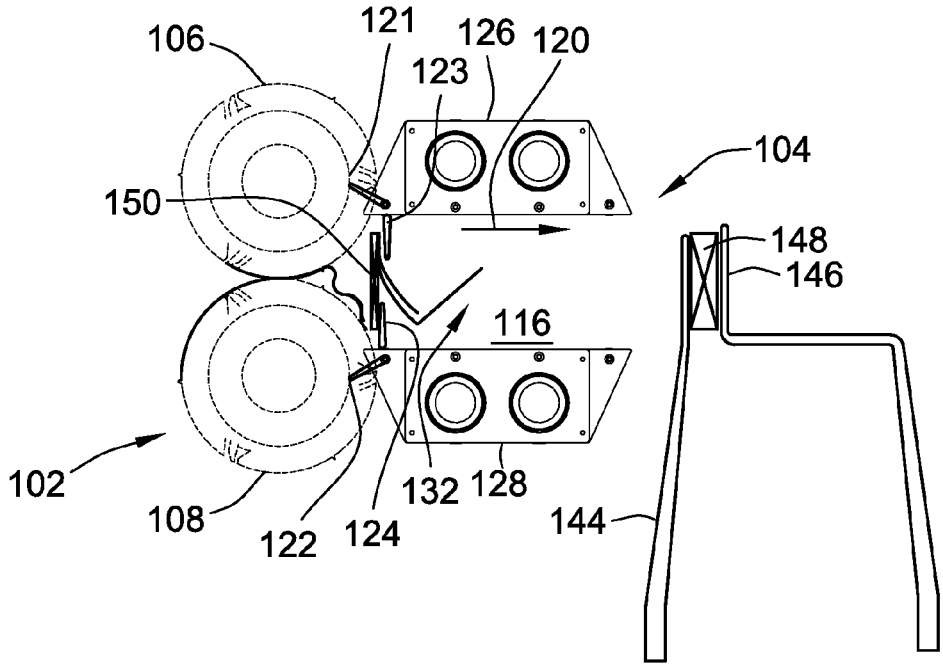
Figure 13:
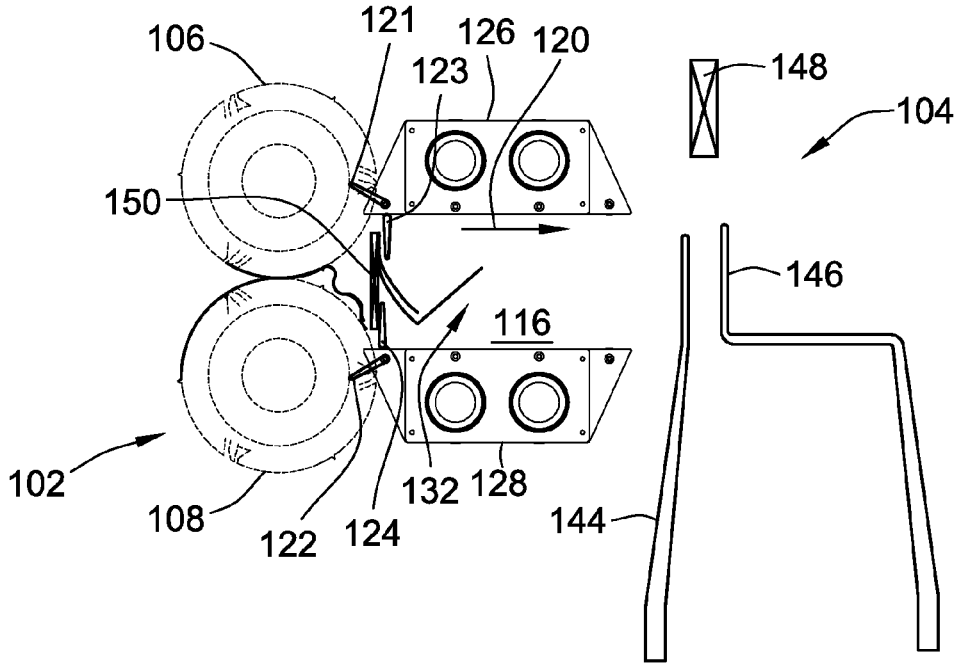

As shown sequentially in FIGS. 12 and 13, once the strip finger 144 has been inserted into the gap 132 in the stacking region 116, to support the upstream end of the completed pack 148 in the manner described above with reference to FIG. 11, the strip finger 144 and build finger 146 move the completed pack 148 to a point in the stacking region 116, as illustrated in FIG. 12, whereat the completed pack 148 can be released by the strip and build fingers 144, 146 and moved out of the stacking region 116, in the manner illustrated in FIG. 13. During the time in which the strip and build fingers 144, 146 are moving the completed pack 148 out of the stacking region 116, the third and fourth count fingers 123, 124 continue to move in a downstream direction 120 at the build rate, to accommodate additional sheets being added to the upstream end of the next pack 150. During this same period of time, the first and second count fingers 121, 122 remain in the ready retracted position as shown in FIGS. 12 and 13. Alternatively, in some embodiments of the invention, the separator arrangement 104 may utilize the time during which the completed pack is being handled by the build and strip fingers 144, 146 to transport the first and second count fingers 121, 122 back to the ready position shown in FIGS. 12 and 13.

Figure 14:
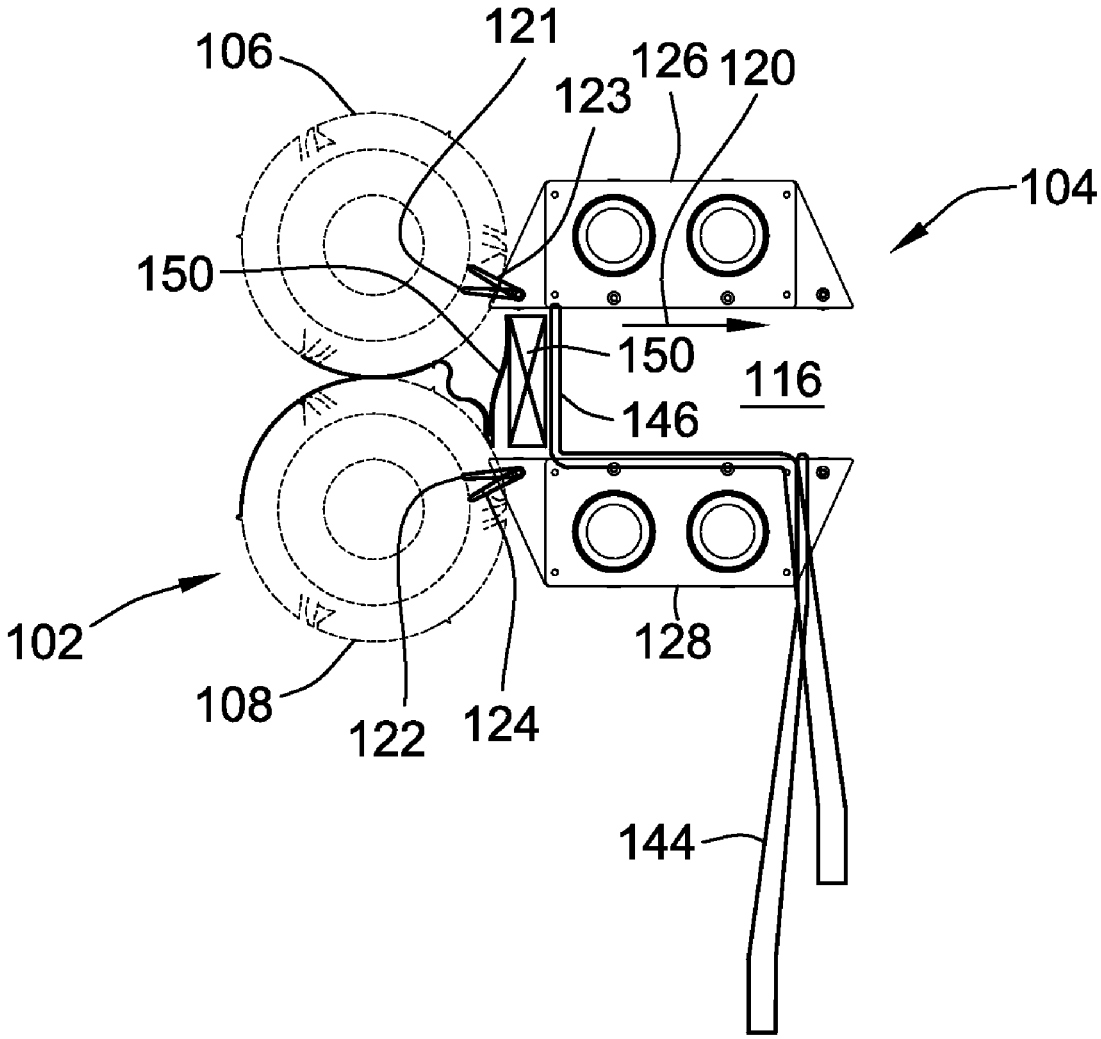

As shown in FIG. 14, once the strip and build fingers 144, 146 have released the completed pack 148, the strip finger 144 is returned to the ready position wherein it does not extend into the stacking region 116. The build finger 146 is moved in an upstream direction through the stacking region 116, and the third and fourth count fingers 123, 124 are moved to a retracted ready position to transfer the downstream surface of the next pack 150 to the build finger 146. From this point, the separator apparatus 144 repeats the process described above in relation to FIGS. 8-13, to separate the next pack 150 from the stack 115 when the desired number of sheets have been deposited by the folding rolls 106, 108 against the upstream end of the next pack 150. The process described hereinabove is repeated to form each successive pack from the stream of folded sheets issuing from the folding rolls 106, 108 into the stacking region 116.

It is contemplated that in alternate embodiments of the invention, the strip and build fingers 144, 146 may be refracted for releasing the completed pack 148, rather than having the completed pack 148 be removed from between the strip and build fingers 144, 146 in the manner shown in FIG. 13. It is contemplated, for example, that where small, or flat packs of folded product are produced, it may be preferable to move the completed pack 148 out from between the strip and build fingers 144, 146 prior to moving the strip and build fingers 144, 146 to the retracted ready position in the manner described above in relation to FIG. 13. It is further contemplated, for example, that when large, or bulk packs of folded product are being produced that it may be preferred to retract the strip and build fingers 144, 146 from the completed pack 148, prior to moving the completed pack 148 out of alignment with the stacking region 116.

Figure 15:
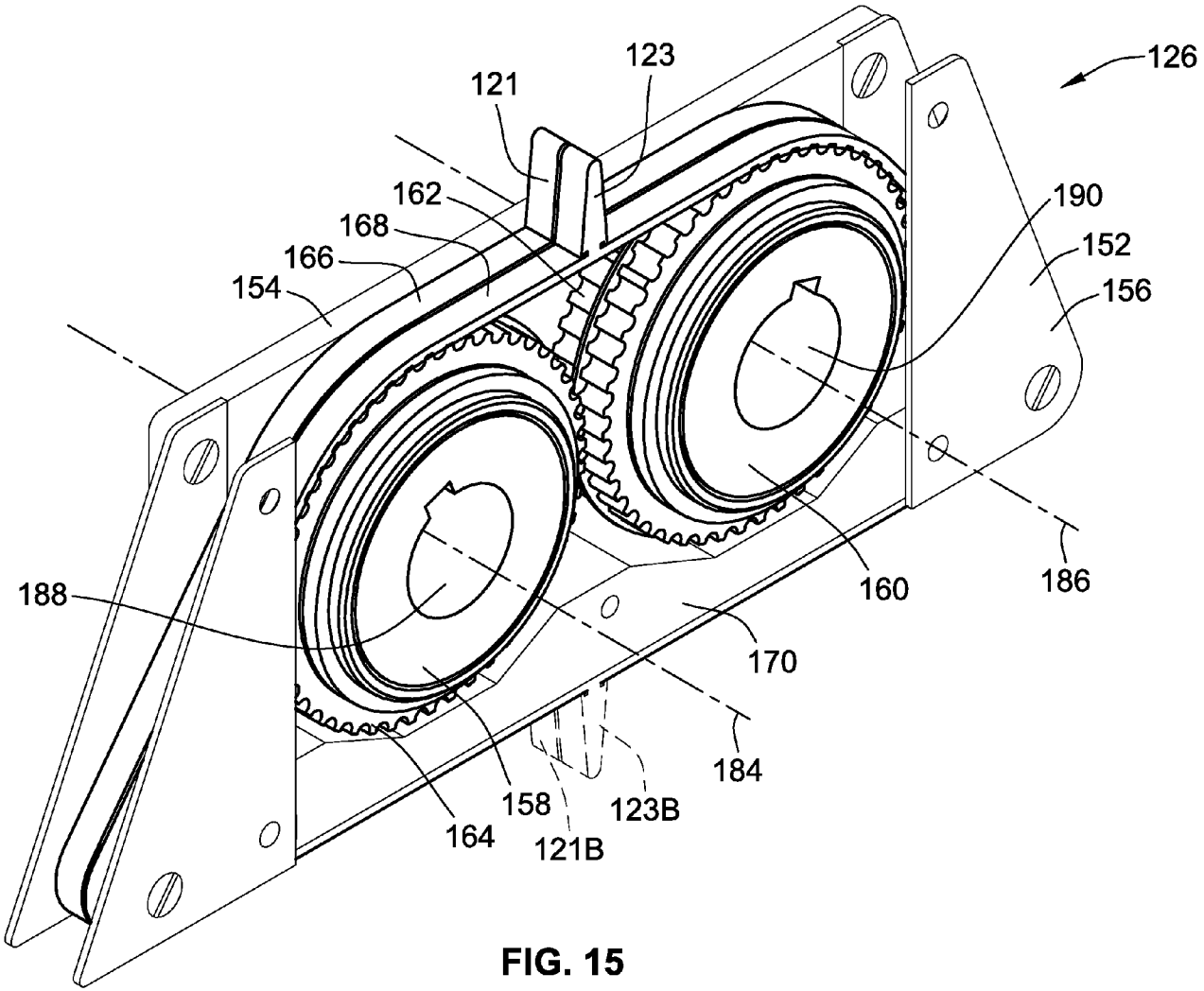
FIG. 15 is a perspective illustration of a count finger cassette, according to the invention.
Figure 16:
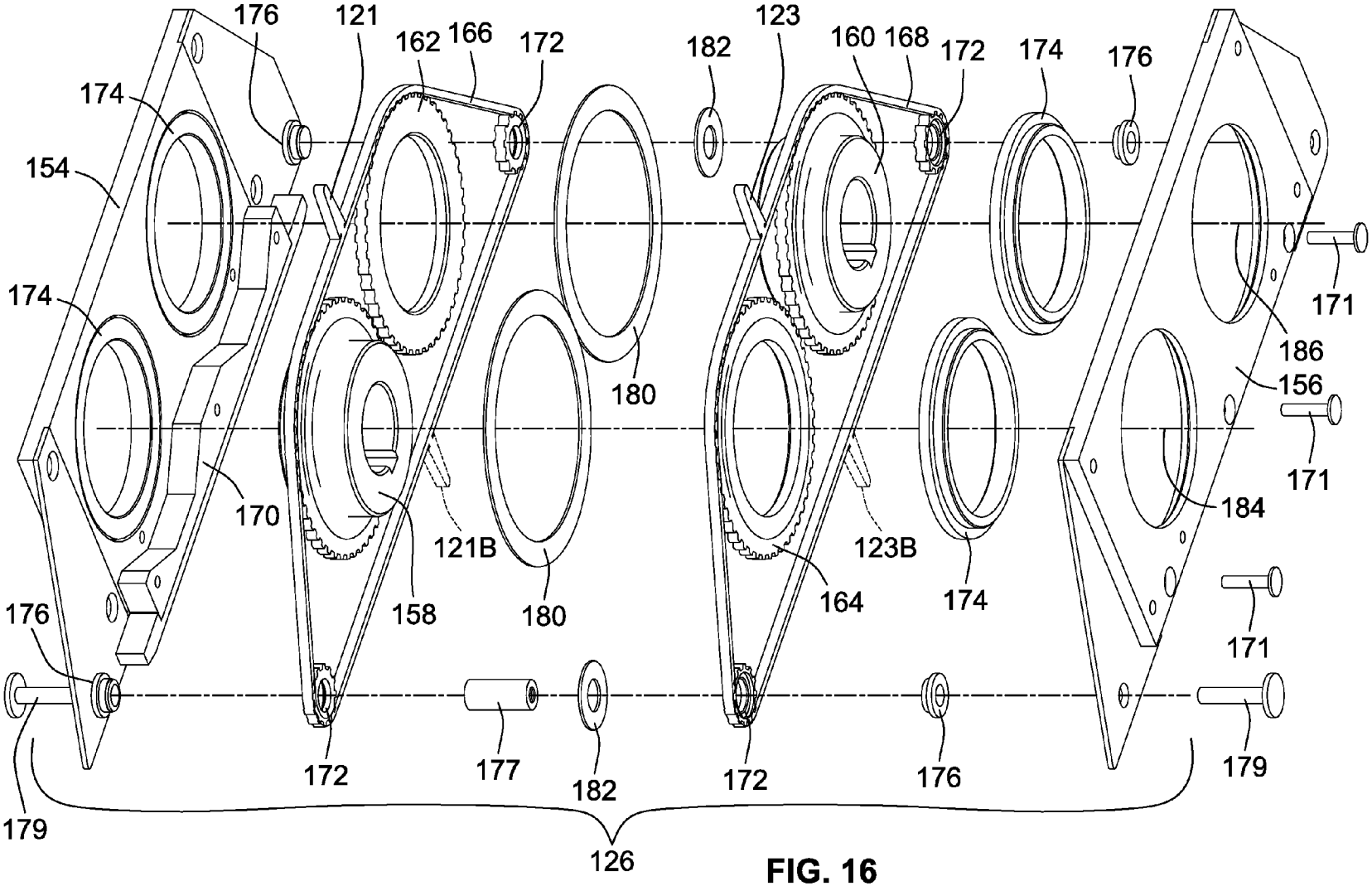
FIG. 16 is an exploded perspective illustration of the count finger cassette of FIG. 15.

FIGS. 15 and 16 show an assembled and a partially exploded view, respectively, of the first count finger cassette 126 of the exemplary embodiment of the separator arrangement 104 described hereinabove. In the first exemplary embodiment of the separator arrangement 104, the first and second count finger cassettes 126, 128 are of identical construction, and are thus interchangeable in the separator arrangement 104. Accordingly, only the first count finger cassette 126 will be described in detail.

The count finger cassette 126 includes a frame 152, having first and second side plates 154, 156. For purposes of illustration, a portion of the second side plate 156 has been removed in FIG. 15.

As further shown in FIGS. 15 and 16, the count finger cassette 126 also includes first and second rotatable drive pulleys 158, 160; first and second rotatable primary idler pulleys 162, 164; first and second endless drive members, in the form of first and second synchronous cogged belts 166, 168 with the first cogged belt 166 having the first count finger 121 attached at a proximal end of the first count finger 121 to the outer surface of the first cogged belt 166, and the second cogged belt 168 having the second count finger 123 attached at a proximal end of the second count finger 123 to the outer surface of the second cogged belt 168; a guide element 170; four secondary idler pulleys 172; four drive pulley bearings 174; four secondary idler pulley bearings 176; two secondary idler pulley shafts 177; two large spacer washers 180; and, two small spacer washers 182.

The four drive pulley bearings 174 are mounted in the side plates 154, 156. The four secondary idler pulley bearings 176 are pressed into the four secondary idler pulleys 172, with one of the four secondary idler pulley bearings 176 being pressed into each of the four secondary idler pulleys 172. The secondary idler pulley shafts 177 extend through the secondary idler pulley bearings 176 and the small spacer washers 182, and are fixedly attached to the first and second side plates 154, 156 at opposite ends of the secondary pulley shafts 177 by screws 179 which threadably engage the secondary idler pulley shafts 177 and secure them to the side plates 154, 156.

The frame 152 of the count finger cassette 126 defines first and second spaced parallel rotational axes 184, 186. The first and second drive elements, in the form of the first and second drive pulleys 158, 160 are respectively journaled by the drive pulley bearings 174 for rotation independently from one another about the first and second rotational drive axes 184, 186.

As shown in FIG. 15, the first drive pulley 158 has a keyed central bore 188 therein adapted to receive a first driving input for driving the first drive pulley 158 about the first drive axis 184. In similar fashion, the second drive pulley 160 has a keyed central bore 190 therein adapted to receive a second driving input for driving the second drive pulley 160 about the second drive axis 186.

The first primary idler pulley 162 is journaled for rotation upon a hub portion of the second primary drive pulley 160 about the second rotational axis 186, and one of the large spacer washers 180 is positioned between the second drive pulley 160 and the first primary idler pulley 162, so that the first primary idler pulley 162 may rotate freely and independently from the second drive pulley 160. In similar fashion, the second primary idler pulley 164 is journaled on a hub of the first drive pulley 158, and one of the large spacer washers 180 is positioned between the second primary idler pulley 164 and the first drive pulley 158 in such a manner that the second primary idler pulley 164 can rotate about the first axis 184 independently from first drive pulley 158.

As best seen in FIG. 16, the outer peripheries of the first drive pulley 158, the first primary idler pulley 162, and two of the secondary idler pulleys 172 associated with the first drive pulley 158 all have cogged outer peripheries which mate with the cogs on the inner surface of the first cogged belt 166 to define a first substantially planar path for travel of the first cogged belt 166 extending generally perpendicularly to and around the first and second rotational axes 184, 186. In the exemplary embodiment of the count finger cassette 126 shown and described herein, the first planar path is substantially trapezoidal in shape, defined by the positioning of the first drive pulley 158, the first idler pulley 162 and the two secondary idler pulleys 172 meshing with the first cogged belt 166. It will be understood, however, that in other embodiments of the invention the path traversed by the count finger may be substantially different in shape from that shown in the exemplary embodiment.

The guide member 170 is attached to the side plates 154, 156 along a lower edge thereof, as shown in FIGS. 15 and 16. The guide member 170 is attached to the side plates 154, 156 by a series of screws 171 threaded from either side into the guide member. The guide member 170 is located inside of the portions of the first and second cogged belts 166, 168 extending between respective pairs of the secondary idler pulleys 172. The guide member 170 is configured for urging both the first and second drive belts 166, 168 to travel substantially in parallel with one another along a straight line for a working portion of their respective paths of travel between the secondary idler pulleys 172. The guide 170 is further configured to separate the first and second cogged belts 166, 168 from one another, so that they may move freely and independently with respect to one another along the guide. The small spacer washers 182 are disposed between adjacent secondary idler pulleys 172 so that they can rotate independently from one another.

As will be appreciated from an examination of FIGS. 1-13, the cassette 126 is positioned with the straight surface of the guide 170 extending along one or the other transverse edge of the stacking region 116, so that the count fingers 121, 123 can remain engaged with the openings in the stack 115 during the working portion of their respective paths as the count fingers move along the stacking region 116 in the downstream direction 120.

It will be appreciated, by those having skill in the art, that while the first and second cogged belts 166, 168 travel in substantially parallel paths in their respective planes, in other embodiments of the invention, it may be desirable to have the paths traversed by adjacent flexible drive members be of a different shape from one another. It will also be appreciated that other embodiments of the invention may use different forms of flexible guide members, such as other types of belts, chains, cables, tapes or straps, etc. It will further be appreciated that different types of drive and idler members may be utilized in other embodiments of the invention. It is also contemplated that in some embodiments of the invention a drive mechanism other than the keyed central bores 188, 190 in the drive members may be utilized. For example, a geared drive arrangement is contemplated wherein the drive members in the cassettes are driven by gear train rather that being directly mounted upon and driven by the count finger drive shafts 192, 194, 208, 210. Other drive arrangements are also contemplated within the scope of the invention.

By virtue of the construction and configuration of the exemplary embodiment of the count finger cassette 126 described above, it will be appreciated that the first and second count fingers 121, 123 may be moved independently relative to one another by rotational inputs applied respectively to the first and second drive pulleys 158, 162.

As further indicated in FIGS. 15 and 16, by dashed lines, in some embodiments of a count finger cassette, according to the invention, it may be desirable to attach multiple count fingers 121, 121B, 123, 123B at an angular spacing from one another. In the embodiment shown in FIGS. 15 and 16, for example, a second count finger 121B is shown in dashed lines attached to the outer surface of the first cogged belt 166 at an angular displacement of 180 degrees from the other count finger 121 shown in solid lines. In similar fashion, in the embodiment shown in FIGS. 15 and 16, for example, a second count finger 123B is shown in dashed lines attached to the outer surface of the first cogged belt 166 at an angular displacement of 180 degrees from the other count finger 123 shown in solid lines. Having multiple count fingers on the endless drive members of a count finger cassette, according to the invention, may provide additional speed and operational flexibility in practicing the invention. It will be understood that, in other embodiments of the invention, three or more multiple count fingers may be attached to a single endless drive member at appropriate angular spacings.

Figure 17:
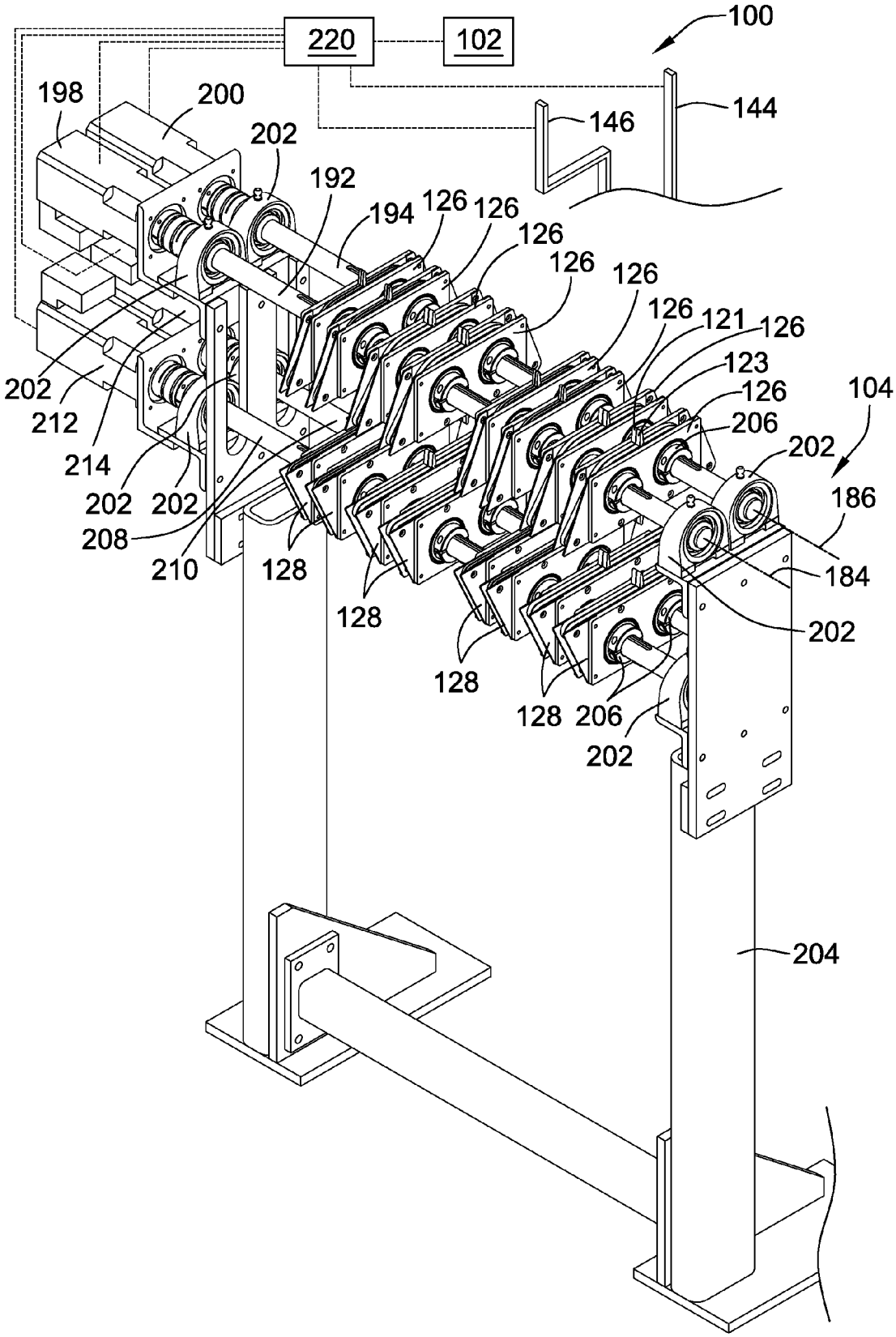
FIG. 17 is a perspective illustration of a separator arrangement, according to the invention, having multiple count finger cassettes according to FIGS. 15 and 16 mounted for operation by four drive actuators.

FIG. 17 is a perspective illustration of the exemplary embodiment of the separator arrangement 104, which illustrates further components and aspects of the invention. As shown in FIG. 17, the separator arrangement 104 includes eight first count finger cassettes 126 mounted in a side-by-side arrangement along a pair of first and third count finger drive shafts 192, 194 extending through the first and second keyed bores 188, 190 respectively, of the first count finger cassettes 126, from first and third count finger actuator motors 198, 200. The first and third count finger drive shafts 192, 194 are mounted at opposite axial ends thereof in a series of pillow block bearings 202 attached to a separator frame 204. The individual first count finger cassettes 126 are locked in place axially along the first and third drive shafts 192, 194 by a plurality of clamping collars 206. It will be appreciated, that the first count finger cassettes 126 are entirely supported by the first and third count finger drive shafts 192, 194 passing through the keyed bores 188, 190 in the individual first count finger cassettes 126.

The respective first and third count fingers 121, 123 in each of the first count finger cassettes 126 are aligned with one another, in such a manner that when the first count finger actuator motor 198 rotates the first count finger drive shaft 192, the keyed connection between the first count finger drive shaft 192 and the first drive pulley 158 of each of the first count finger cassettes 126 causes only the first count fingers 121 to move about the path defined by the first cogged belt 166 in unison with one another and in alignment with one another substantially parallel to the first and second rotational axes 184, 186. In similar fashion, third count fingers 123 in each of the first count finger cassettes 126 are aligned with one another, in such a manner that when the third count finger actuator motor 200 rotates the third count finger drive shaft 194, the keyed connection between the third count finger drive shaft 194 and the second drive pulley 160 of each of the first count finger cassettes 126 causes only the third count fingers 123 to move about the path defined by the second cogged belt 168 in unison with one another and in alignment with one another substantially parallel to the first and second rotational axes 184, 186.

As further shown in FIG. 17, the separator arrangement 104 also includes eight second count finger cassettes 128 mounted in a side-by-side arrangement along a pair of second and fourth count finger drive shafts 208, 210 extending through keyed bores of the second count finger cassettes 128 from second and fourth count finger actuator motors 212, 214. The second and fourth count finger drive shafts 208, 210 are mounted at opposite axial ends thereof in a series of the pillow block bearings 202 attached to the separator frame 204. The individual second count finger cassettes 128 are locked in place axially along the second and fourth drive shafts 208, 210 by the plurality of the clamping collars 206. The second count finger cassettes 128 are entirely supported by the second and fourth counter finger drive shafts 208, 210 passing respectively through the keyed bores 188, 190 in the individual second count finger cassettes 128.

The respective second count fingers 122, in each of the second count finger cassettes 128 are aligned with one another, in such a manner that when the second count finger actuator motor 212 rotates the second count finger drive shaft 208, the keyed connection 180 between the second count finger drive shaft 208 and the first drive pulley 158 of each of the second count finger cassettes 128 causes the second count fingers 122 to move about the path defined by the first cogged belt 166 of the second count finger cassettes 128 in unison with one another and in alignment with one another substantially parallel to the rotational axes of the second count finger cassettes 128.

In similar fashion, the respective fourth count fingers 124 in each of the second count finger cassettes 128 are aligned with one another in such a manner that, when the fourth count finger actuator motor 214 rotates the fourth count finger drive shaft 210, the keyed connection 190 between the fourth drive shaft 210 and each of the second count finger cassettes 128 causes the fourth count fingers 124 to move in unison with one another and in alignment with one another substantially parallel to the rotational axes of the second count finger cassette 128.

As yet further shown in FIG. 17, the exemplary embodiment of the separator arrangement 104 also includes a controller 220 which is operatively connected between the count finger drive actuators 198, 200, 212, 214, the strip finger 144, the build finger 146 and the folding arrangement 102, for controlling operation of the folding and separating apparatus 100.

Those having skill in the art will appreciate the arrangement shown in FIG. 17, as being applicable to applications in which the material being folded has an extended width, resulting in the folded stack having a substantial length in the direction in and out of the paper as illustrated in FIGS. 1-13. In such applications, the stack of folded materials, and individual packs made therefrom are sometimes referred to as "logs" which are then sawed or otherwise cut into a plurality of packs having a shorter length during further processing of the packs of folded material.

It will also be appreciated, by those having skill in the art, that the construction of the count finger cassettes 126, 128 described herein results in a compact and narrow structure.

With reference to FIGS. 1-13, it will be appreciated that the narrow width of the cassettes, allows them to extend at least partially into annular grooves 125, 131 opening outward through the periphery of the folding rolls 106, 108. This allows the count fingers 121, 122, 123, 124 to be inserted into the openings in the stack 115 at a point very close to where the folded sheets are leaving the periphery of the folding rolls 106, 108. As shown in FIG. 1, the annular grooves 125, 131 extend deeply enough into the respective first and second folding rolls 106, 108 for the distal ends of the count fingers 121, 122, 123, 124 to rotate about the upstream ends of the first and second count finger cassettes 126, 128 without having the distal ends of the count fingers 121, 122, 123, 124 come into contact with the bottom of the annular grooves 125, 131. The depth of the annular grooves 125, 131 is also sufficient to operatively receive the portions of the count finger cassettes 126, 128 forming the first and second strip surfaces 127, 129.

It will be further understood, that where the annular grooves 125, 131 define a width thereof in the axial direction of the roll axes 110, 112, the portion of the count finger cassette 126, 128 disposed in the annular grooves 125, 131 has a width in the direction of the roll axis 110, 112 that is less than the width of the annular grooves 125, 131, so that the rolls 106, 108 may rotate freely without contacting the sides of the count fingers 121, 122, 123, 124. Experience has shown, that in practicing the invention with a count finger cassette in accordance with the invention, the cassette can have a width which is small enough that other elements often used in folding arrangements having folding rolls, such as packer fingers for example, can also fit within and operate freely next to the count finger cassette within an annular groove in the folding roll.

Although the exemplary embodiment of the invention described herein utilize count finger cassettes having two count fingers per cassette, it will be understood that the invention may be practiced with efficacy and other embodiments having fewer or more count fingers operatively disposed within a single cassette.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method for separating a stack of folded sheets disposed in a stacking region extending from an upstream to a downstream direction along a folded sheet path into packs having a desired number of folded sheets, wherein the folded sheets in the stack have successive folds in the stack alternatively disposed on opposite sides of the folded sheet path with each fold joining two successive panels opening from one another on the opposite side of the folded sheet path to form an opening between successive folds, the method comprising:

inserting first, second, third and fourth count fingers into the stack respectively into four successive openings in the stack, and separating the stack between the second and third fingers to form a completed pack downstream from the second count finger.

2. The method of claim 1, further comprising, moving the completed pack out of the stacking region.

3. The method of claim 1, further comprising, supporting a downstream end of the completed pack with a build finger.

4. The method of claim 1, further comprising, pulling the completed pack away from the remainder of the stack by moving the inserted first and second count fingers together in a downstream direction.

5. The method of claim 1, further comprising:

inserting the first and second count fingers into the stack at opposite transverse edges of a penultimate panel of a last folded sheet of the completed pack downstream and upstream respectively from the penultimate panel; and inserting the third and fourth count fingers into the stack at opposite transverse edges of a second panel of a first sheet of the next pack upstream and downstream respectively from the second panel.

6. The method of claim 1, further comprising, inserting a strip finger between the second and third count fingers over a penultimate panel of the completed pack.

7. The method of claim 1, further comprising, positioning a build finger downstream from a first panel of a next pack, for supporting the downstream end of the next pack, and retracting the third and fourth count fingers.

8. The method of claim 1, further comprising, moving the first and second count fingers away from the third and fourth count fingers after all four count fingers are inserted into the four successive openings.

9. The method of claim 8, further comprising, moving the first and second count fingers away from the third and fourth count fingers in the downstream direction after all four count fingers are inserted into the four successive openings.

10. The method of claim 8, further comprising, momentarily stopping movement in the downstream direction of the first and second count fingers while continuing to move the third and fourth count fingers in the downstream direction, after all four count fingers are inserted into the four successive openings.

11. The method of claim 8, further comprising, moving the first and second count fingers in the upstream direction after all four count fingers are inserted into the four successive openings.

12. The method of claim 8, further comprising, inserting a strip finger into the stack between the second and third count fingers and then moving the strip finger in the downstream direction together with the first and second count fingers.

13. The method of claim 12, further comprising, inserting a build finger between the second and third count fingers, downstream from a first panel of a next pack, for supporting the downstream end of the next pack, and retracting the third and fourth count fingers.

14. The method of claim 1, wherein:

the stack of folded sheets is moving at a build rate in a downstream direction along the folded sheet path as folded sheets are added to an upstream end of the stack in the folding region; and the method further includes, inserting the four count fingers into the moving stack and moving the four count fingers in a downstream direction along the folded sheet path as the stack continues to build upstream from the count fingers in the folding region.

15. The method of claim 1, further comprising, moving the first and second count fingers away from the third and fourth count fingers after all four count fingers are inserted into the four successive openings, to thereby create a gap between the second and third count fingers.

16. The method of claim 15, further comprising, forming the gap by moving the first and second count fingers away from the third and fourth count fingers in the downstream direction after all four count fingers are inserted into the four successive openings.

17. The method of claim 15, further comprising, forming the gap by momentarily stopping movement in the downstream direction of the third and fourth count fingers while continuing to move the first and second count fingers in the downstream direction, after all four count fingers are inserted into the four successive openings.

18. The method of claim 15, further comprising, forming the gap by moving the third and fourth count fingers in the upstream direction after all four count fingers are inserted into the four successive openings.

19. The method of claim 15, further comprising, inserting a strip finger into the gap between the second and third count fingers and then moving the strip finger in the downstream direction together with the first and second count fingers.

20. The method of claim 15, further comprising, inserting a build finger into the gapdownstream from the third and fourth count fingers, for supporting the downstream end of a next pack, and then retracting the third and fourth count fingers.

21. The method of claim 20, further comprising:

supporting a downstream end of the completed pack with the build finger positioned downstream from the first and second count fingers;

moving the completed pack out of the stacking region; and then repositioning the build finger downstream from the third and fourth count fingers for supporting the downstream end of the next pack.

22. The method of claim 15, further comprising:

inserting a strip finger into the gap between the second and third count fingers over a penultimate panel of the completed pack; and then moving the strip finger in the downstream direction together with the first and second count fingers.

23. The method of claim 22, further comprising:

inserting a build finger downstream from a first panel of a next pack, for supporting the downstream end of the next pack; and then retracting the third and fourth count fingers.

24. The method of claim 23, further comprising, moving the completed pack out of the folding region.

25. The method of claim 1, further comprising, using the same set of four count fingers for making each and every separation of the stack into packs.

26. The method of claim 1, further comprising, using another set of four count fingers for making the next separation in the stack, in the same manner as the separation was performed using the first set of count fingers to perform the first separation.

27. The method of claim 1, further comprising, driving each count finger independently.

28. The method of claim 27, further comprising, mounting corresponding count fingers from the first and second sets of count fingers on four endless drive members, and driving each endless drive member independently.

29. The method of claim 28, further comprising, mounting the corresponding count fingers on their respective endless drive members at 180 degrees of angular displacement from one another.

30. The method of claim 1, wherein:

the sheets have at least one full-width panel defining a full panel width W formed by interaction of first and second folding rolls having respective peripheries thereof operatively disposed to form a nip therebetween, with the folded sheet path extending through the nip;

the stacking region is partly defined by first and second datum planes disposed on opposite sides of the sheet path and spaced from the sheet path at respective datum spacings (w) substantially equal to one-half of the full-panel width W, to form a first point of intersection between the periphery of the first folding roll and the first datum plane at an upstream end of the stacking region and a second point of intersection between the periphery of the second folding roll and the second datum plane at an upstream end of the stacking region;

and the method further comprises, inserting the first and third count fingers into the stack substantially at one of the first and second intersection points and inserting the second and fourth count fingers into the stack substantially at the other of the first and second intersection points.

31. The method of claim 30, further comprising, stripping the sheets from the first and second rolls substantially at the respective first and second points of intersection.

32. The method of claim 31, further comprising, positioning a folded sheet guide at one or both of the points of intersection for urging separation of the sheets from the periphery of the roll.

33. The method of claim 1, wherein the step of inserting first, second, third and fourth count fingers into the stack respectively into four successive openings in the stack, and separating the stack between the second and third fingers to form a completed pack downstream from the second count finger is performed by an apparatus comprising:

first, second, third and fourth count fingers configured and operatively connected for sequential insertion, starting with the first count finger and ending with the fourth count finger, into the stack to separate the stack, between the second and third count fingers into the completed pack downstream from the second count finger and further into a next pack upstream from the third count finger.

* * * * *